US011525455B2

(12) United States Patent
Lee et al.

(10) Patent No.: US 11,525,455 B2
(45) Date of Patent: Dec. 13, 2022

(54) DOUBLE SUCTION FAN AND AIR CONDITIONER HAVING THE SAME

(71) Applicant: Samsung Electronics Co., Ltd., Suwon-si (KR)

(72) Inventors: Kisup Lee, Suwon-si (KR); Jinbaek Kim, Suwon-si (KR); Kyunghoon Kim, Suwon-si (KR); Jaehyoung Sim, Suwon-si (KR); Dohoon Kim, Suwon-si (KR); Seonghyun Yoon, Suwon-si (KR); Joonho Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 161 days.

(21) Appl. No.: 16/697,950

(22) Filed: Nov. 27, 2019

(65) Prior Publication Data

US 2020/0173455 A1 Jun. 4, 2020

(30) Foreign Application Priority Data

Nov. 30, 2018 (KR) ..... 10-2018-0151705

(51) Int. Cl.
*F04D 29/28* (2006.01)

(52) U.S. Cl.
CPC ..... *F04D 29/283* (2013.01)

(58) Field of Classification Search
CPC ..... F04D 29/283; F04D 17/162; F04D 29/281
See application file for complete search history.

(56) References Cited

U.S. PATENT DOCUMENTS 4,324,529 A 4/1982 Nickels
4,329,118 A 5/1982 Ranz
(Continued)

FOREIGN PATENT DOCUMENTS

CN 1734101 A 2/2006
CN 102828994 A 12/2012
(Continued)

OTHER PUBLICATIONS

Office Action dated Jan. 7, 2022 issued in Chinese Patent Application No. 201911197538.5.
(Continued)

*Primary Examiner* — Sabbir Hasan
(74) *Attorney, Agent, or Firm* — Staas & Halsey LLP

(57) ABSTRACT

A double suction fan includes first and second rings spaced at a predetermined distance apart from and in parallel to each other, an intermediate plate disposed between the first and second rings and including a shaft hole, a plurality of first blades disposed between the first ring and the intermediate plate, a plurality of second blades disposed between the second ring and the intermediate plate, and first and second rotating hubs disposed on both side surfaces of the intermediate plate, wherein each of the first and second rotating hubs is formed of a plurality of hub plates which are disposed perpendicular to the intermediate plate around the shaft hole, and wherein the plurality of hub plates are formed to evenly distribute air introduced through the first and second rings in a longitudinal direction of the plurality of first and second blades when the intermediate plate rotates.

6 Claims, 28 Drawing Sheets

(56) References Cited

U.S. PATENT DOCUMENTS

| | | | | |
|---|---|---|---|---|
| 5,988,979 | A | 11/1999 | Wang | |
| 6,024,543 | A | 2/2000 | Lambertson | |
| 7,682,233 | B2 | 3/2010 | Wang et al. | |
| 9,157,441 | B2 | 10/2015 | Dickinson et al. | |
| 9,574,568 | B2 | 2/2017 | Dickinson et al. | |
| 10,634,168 | B2 * | 4/2020 | Kono | F04D 29/666 |
| 10,704,554 | B2 * | 7/2020 | Nakai | F04D 17/04 |
| 2018/0128271 | A1 | 5/2018 | Bergamini et al. | |

FOREIGN PATENT DOCUMENTS

| | | | | |
|---|---|---|---|---|
| CN | 203685679 | U | | 7/2014 |
| CN | 104791296 | A | * | 7/2015 |
| CN | 104791296 | A | | 7/2015 |
| CN | 104806567 | A | | 7/2015 |
| EP | 2 221 486 | A2 | | 8/2010 |
| FR | 2 770 878 | B1 | | 1/2002 |
| JP | 2001-27199 | A | | 1/2001 |
| KR | 10-1309084 | B1 | | 9/2013 |
| KR | 10-2017-0123128 | | | 11/2017 |
| KR | 10-1850287 | | | 4/2018 |
| KR | 10-2019-0071391 | | | 6/2019 |

OTHER PUBLICATIONS

Extended European Search Report dated Apr. 6, 2020, in corresponding European Patent Application No. 19212339.6.
Chinese Office Action dated Nov. 20, 2020, in corresponding Chinese Patent Application No. 201911197538.5.
Communication pursuant to Article 94(3) EPC dated Jan. 14, 2021, in corresponding European Patent Application No. 19 212 339.6.

* cited by examiner

DOUBLE SUCTION FAN AND AIR CONDITIONER HAVING THE SAME

CROSS-REFERENCE TO RELATED APPLICATIONS

This application is based on and claims priority under 35 U.S.C. § 119 to Korean Patent Application No. 10-2018-0151705, filed on Nov. 30, 2018, in the Korean Intellectual Property Office, the disclosure of which is incorporated by reference herein in its entirety.

BACKGROUND

1. Field

The disclosure relates to a double suction fan and an air conditioner having the same.

2. Description of the Related Art

Generally, a double suction fan is used in an air conditioner to draw outside air and blow the outside air to a heat exchanger.

The double suction fan is formed to suck air through two inlets provided on both sides thereof and to discharge the air through the circumferential surface thereof. In such a double suction fan, the flow of air is concentrated to the center portion of the double suction fan.

Because the double suction fan is usually manufactured through plastic molding such as injection and the like, the double suction fan may not be provided with a hub structure for dispersing air flow in the center portion of the double suction fan due to the mold structure. Therefore, in the double suction fan, the air sucked through both sides is concentrated in the center portion.

In particular, when the air volume of the double suction fan is increased, the suction flow velocity of the air is faster and the momentum thereof is increased, so that the concentration of the air flow in the center portion is more severe. On the contrary, in the regions adjacent to the inlets in both side surfaces of the double suction fan, air flow is not formed and backflow occurs. In addition, the concentration of air flow into the center portion is aggravated when the length of the double suction fan is increased. For example, in the double suction fan having a length of 320 mm, the air flow concentration phenomenon at the center portion occurs more severely than in the double suction fan having a length of 200 mm. When this phenomenon occurs, the air flow is concentrated only on a portion of the heat exchanger of the air conditioner, so that the resistance against the air flow may be increased, and as a result, the performance of the air conditioner may be reduced.

In order to solve this problem, two fans forming a double suction fan may be separately injected into a single suction fan shape having a hub in the center. After that, the two single suction fans may be fused by ultrasonic waves or the like to produce a double suction fan having a hub. However, the method of manufacturing the double suction fan as described above is very expensive, and it is difficult to balance the weight balance of both single suction fans. Therefore, it is difficult to apply the double suction fan manufactured by the above-described method to commercial air conditioners.

SUMMARY

The disclosure has been developed in order to overcome the above drawbacks and other problems associated with the conventional arrangement. An aspect of the disclosure relates to a double suction fan having a rotating hub that can prevent concentration of air in a center portion and can be produced through an injection process, and an air conditioner having the same.

According to an aspect of the disclosure, a double suction fan may include first and second rings spaced at a predetermined distance apart from and in parallel to each other; an intermediate plate disposed between the first ring and the second ring and including a shaft hole formed in a center thereof; a plurality of first blades disposed between the first ring and the intermediate plate; a plurality of second blades disposed between the second ring and the intermediate plate; and first and second rotating hubs disposed on both side surfaces of the intermediate plate, wherein each of the first and second rotating hubs may be formed of a plurality of hub plates which are disposed perpendicular to the intermediate plate around the shaft hole, and wherein the plurality of hub plates may have a smooth shape without protrusions on an outer surface and are formed to evenly distribute air introduced through the first and second rings in a longitudinal direction of the plurality of first blades and the plurality of second blades when the intermediate plate rotates.

When the intermediate plate rotates, a contour formed by the plurality of hub plates may form a shape having a high center portion and a low edge portion.

The plurality of hub plates may include a plurality of circular pipes disposed concentrically about the shaft hole, and lengths of the plurality of circular pipes may become shorter from the center of the intermediate plate to an edge of the intermediate plate.

The plurality of hub plates may include a first circular pipe disposed on the intermediate plate about the shaft hole; and a second circular pipe concentrically disposed outside the first circular pipe and being shorter in length than the first circular pipe.

The plurality of hub plates may include a plurality of wing plates disposed radially at regular intervals on the intermediate plate about the shaft hole, and wherein each of the plurality of wing plates may be formed in a flat plate shape having a high height of one end close to the shaft hole and a low height of another end far from the shaft hole.

The plurality of wing plates may include four wing plates, and the four wing plates may be arranged crosswise around the shaft hole.

The plurality of hub plates may include a plurality of arc plates disposed concentrically about the shaft hole, and lengths of the plurality of arc plates may become shorter from the center of the intermediate plate to an edge of the intermediate plate.

The plurality of hub plates may include a pair of first arc plates disposed symmetrically about the shaft hole; a pair of second arc plates disposed concentrically with the first arc plates and perpendicular to the pair of first arc plates outside the pair of the first arc plates; and a pair of third arc plates disposed concentrically with the pair of first arc plates and perpendicular to the pair of second arc plates outside the pair of the second arc plates, wherein a length of the first arc plate may be longest, and a length of the third arc plate may be shortest.

The plurality of hub plates may include a plurality of arc walls which are disposed concentrically about the shaft hole and provided with a cavity therein, and the plurality of arc walls provided on a first side surface of the intermediate plate on which the plurality of first blades are disposed and the plurality of arc walls provided on the second side surface of the intermediate plate on which the plurality of second blades may be disposed to cross each other.

The plurality of arc walls may include a pair of first arc walls provided on the first side surface of the intermediate plate and facing each other; and a pair of second arc walls provided on portions of the second side surface of the intermediate plate where the pair of first arc walls are not provided along a same circumference as the pair of first arc walls and facing each other.

The plurality of hub plates may include a plurality of sub blades disposed in a circle around the shaft hole and having a length shorter than a length of each of the first blade and the second blade.

The plurality of hub plates may be formed not to interfere with a core configured to form the plurality of hub plates and the plurality of first blades or the plurality of second blades when the core moves in a longitudinal direction of the plurality of first blades or the plurality of second blades, so that the double suction fan may be formed using an injection process.

According to another aspect of the disclosure, an air conditioner may include a motor; and two double suction fans disposed both sides of the motor and configured to be rotated by the motor, each of the two double suction fan including any one of the above-described features.

Other objects, advantages and salient features of the disclosure will become apparent from the following detailed description, which, taken in conjunction with the annexed drawings, discloses preferred embodiments.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION OF THE EMBODIMENTS

Hereinafter, embodiments of a double suction fan and an air conditioner having the same will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the present disclosure, a first component may be referred to as a second component, and similarly, a second component may also be referred to as a first component.

The terms used in embodiments of the present disclosure may be construed as commonly known to those skilled in the art unless otherwise defined.

Further, the terms 'leading end', 'rear end', 'upper side', 'lower side', 'top end', 'bottom end', etc. used in the present disclosure are defined with reference to the drawings. However, the shape and position of each component are not limited by the terms.

Figure 1:
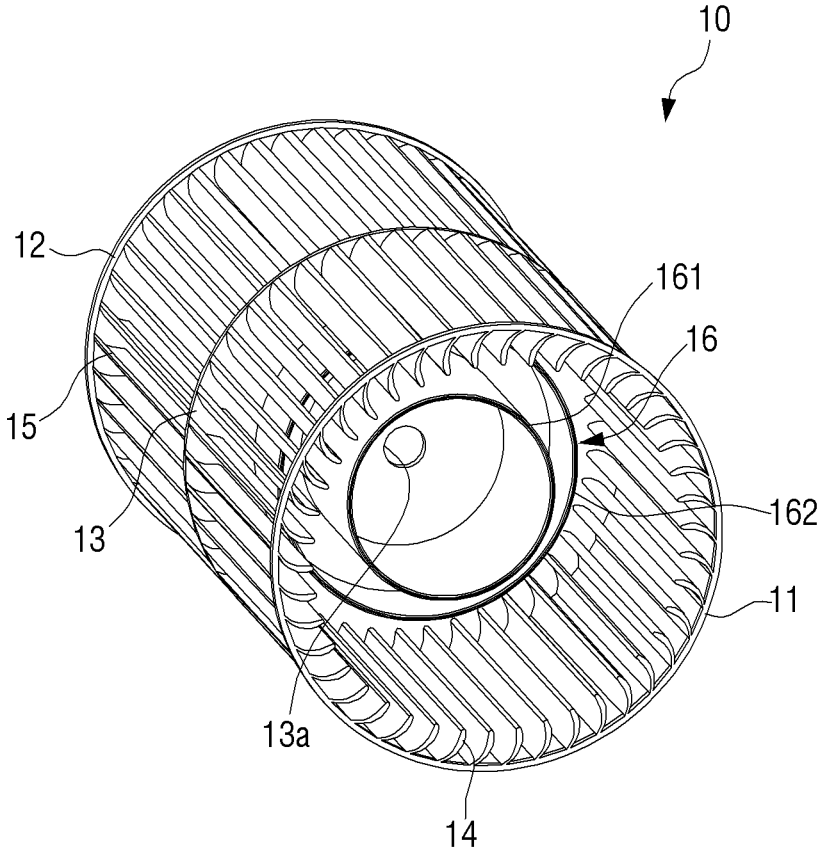
FIG. 1 is a perspective view illustrating a double suction fan according to a first embodiment of the disclosure.

FIG. 1 is a perspective view illustrating a double suction fan according to a first embodiment of the disclosure. FIG.

Figure 3:
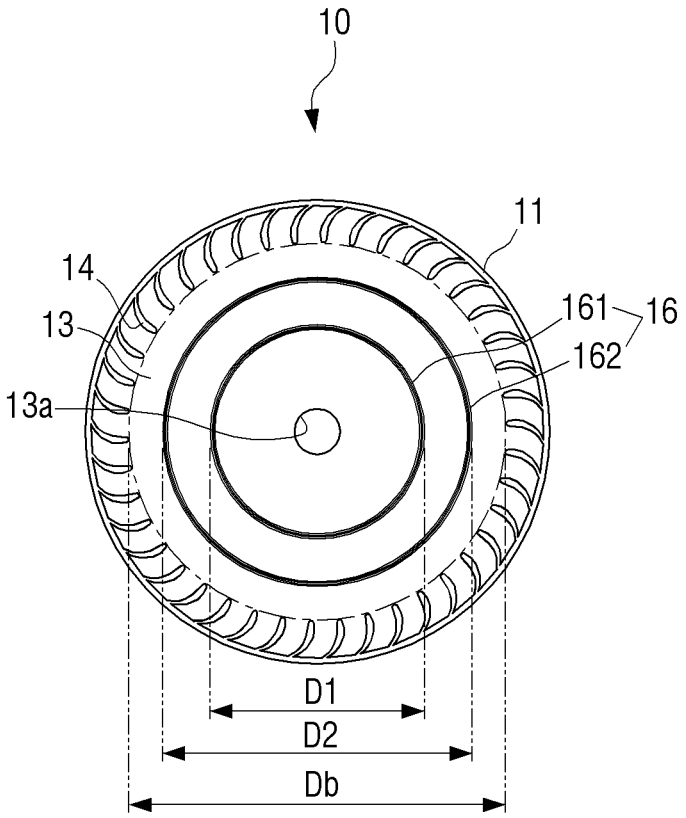
FIG. 3 is a side view illustrating the double suction fan of FIG. 1.

2 is a cross-sectional view illustrating the double suction fan of FIG. 1, and FIG. 3 is a side view illustrating the double suction fan of FIG. 1.

Figure 2:
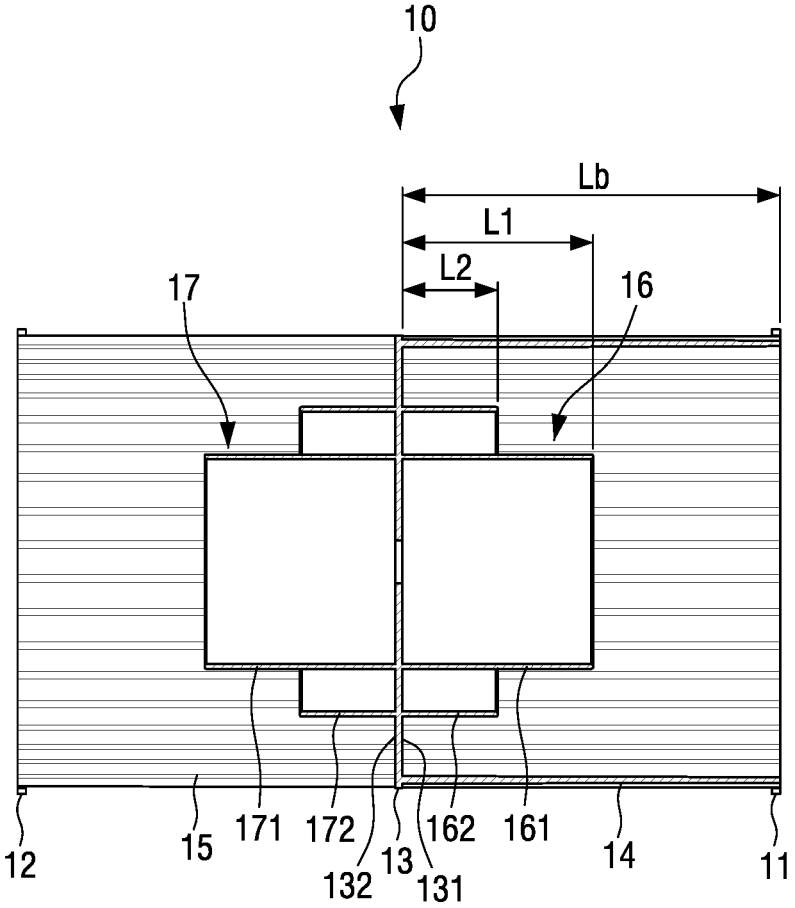
FIG. 2 is a cross-sectional view illustrating the double suction fan of FIG. 1.

Referring to FIGS. 1, 2 and 3, a double suction fan 10 according to an embodiment of the disclosure may include a pair of rings 11 and 12, an intermediate plate 13, a plurality of blades 14 and 15, and a rotating hub 16.

The pair of rings 11 and 12, that is, a first ring 11 and a second ring 12 are spaced apart by a predetermined distance in parallel to each other and form opposite ends of the double suction fan 10. The first ring 11 and the second ring 12 are formed in a circular ring shape, and fix and support one end of each of the plurality of blades 14 and 15. Outside air may be introduced into the double suction fan 10 through the pair of rings 11 and 12.

The intermediate plate 13 is disposed in parallel with the first ring 11 and the second ring 12 between the first ring 11 and the second ring 12. The intermediate plate 13 is formed in a disc having a diameter corresponding to the first ring 11 and the second ring 12. A shaft hole 13*a* is provided in the center of the intermediate plate 13. A shaft 211 (see FIG. 27) that rotates by receiving power from a motor 210 (see FIG. 28) may be fixed to the shaft hole 13*a*. The other ends of the plurality of blades 14 and 15 are fixed to the outer circumferential surface of the intermediate plate 13.

The plurality of blades 14 and 15 are disposed between the pair of rings 11 and 12 and the intermediate plate 13. In detail, the plurality of blades 14 and 15 may include a plurality of first blades 14 disposed between the first ring 11 and the intermediate plate 13 and a plurality of second blades 15 disposed between the second ring 12 and the intermediate plate 13. The plurality of blades 14 and 15 may be formed in a substantially rectangular shape having a narrow width and a long length. In addition, the cross-section of each of the plurality of blades 14 and 15 may be formed in a streamlined shape and in a curved surface curved at a predetermined curvature in the width direction. The plurality of blades 14 and 15 are spaced apart at regular intervals. One end of each of the plurality of first blades 14 is fixed to the first ring 11, and the other end thereof is fixed near the outer circumferential surface to the first side surface 131 of the intermediate plate 13. One end of each of the plurality of second blades 15 is fixed to the second ring 12, and the other end thereof is fixed near the outer circumferential surface to the second surface 132 of the intermediate plate 13.

Rotating hubs 16 and 17 may be provided at both side surfaces 131 and 132 of the intermediate plate 13. The rotating hubs 16 and 17 may be configured to evenly distribute the air, which is introduced through the pair of rings 11 and 12 when the double suction fan 10 is rotated by the motor 210, in the longitudinal direction of the plurality of blades 14 and 15.

In detail, a first rotating hub 16 may be disposed on one surface of the intermediate plate 13, for example, one surface 131 of the intermediate plate 13 facing the first ring 11, and a second rotating hub 17 may be disposed on an opposite surface of the intermediate plate 13, for example, one surface 132 of the intermediate plate 13 facing the second ring 12. Because the first rotating hub 16 and the second rotating hub 17 have the same structure, only the first rotating hub 16 will be described in detail. However, hereinafter, the first rotating hub 16 will be referred to as the rotating hub 16 for convenience of description.

The rotating hub 16 may be formed in a plurality of hub plates 161 and 162 which are disposed perpendicular to the intermediate plate 13 around the shaft hole 13*a*. In this case, the plurality of hub plates 161 and 162 are formed to evenly distribute the air introduced through the first ring 11 in the longitudinal direction of the plurality of first blades 14 when the intermediate plate 13 rotates.

In addition, each of the plurality of hub plates 161 and 162 is formed in a smooth shape without protrusions on its outer surface thereof. When the hub plates 161 and 162 are formed in a smooth shape without protrusions, the plurality of hub plates 161 and 162 may not interfere with hub cores 510 and 520 (see FIG. 5) configured to form the plurality of hub plates 161 and 162 when the hub cores 510 and 520 are moved in the longitudinal direction of the plurality of first blades 14 in order to form the double suction fan 10 through an injection process.

To this end, the plurality of hub plates 161 and 162 may be formed such that the virtual contour formed by the plurality of hub plates 161 and 162 when the intermediate plate 13 rotates has a high center portion and a lower edge portion.

For example, as illustrated in FIGS. 1 to 3, the plurality of hub plates 161 and 162 may include a plurality of circular pipes 161 and 162 concentrically arranged in the intermediate plate 13 about the shaft hole 13*a*. In this case, the lengths of the plurality of circular pipes 161 and 162 may be formed to become shorter from the center to the edge.

In the embodiment illustrated in FIGS. 1 to 3, the plurality of hub plates 161 and 162 include a first circular pipe 161 arranged in the intermediate plate 13 about the shaft hole 13*a* and a second circular pipe 162 arranged concentrically on the outer side of the first circular pipe 161. The first circular pipe 161 provided adjacent to the shaft hole 13*a* has a length longer than the length of the second circular pipe 162 provided adjacent to the plurality of first blades 14.

For example, the length of the first circular pipe 161 may be defined in a range of ⅓ to ⅔ of the length of the first blade 14. In addition, the outer diameter D1 of the first circular pipe 161 may be defined in a range of ⅓ to ⅘ of the virtual inner circular diameter Db formed by the plurality of first blades 14. In this case, the outer diameter D1 of the first circular pipe 161 is defined to be smaller than the outer diameter D2 of the second circular pipe 162 so as to be spaced apart from the second circular pipe 162. The length of the second circular pipe 162 is defined to be shorter than the length of the first circular pipe 161. At the same time, the outer diameter D1 of the first circular pipe 161 and the length of the second circular pipe 162 may be defined so that the contour formed by the first circular pipe 161 and the second circular pipe 162 properly distribute the air flow when the double suction fan 10 rotates.

Figure 4:
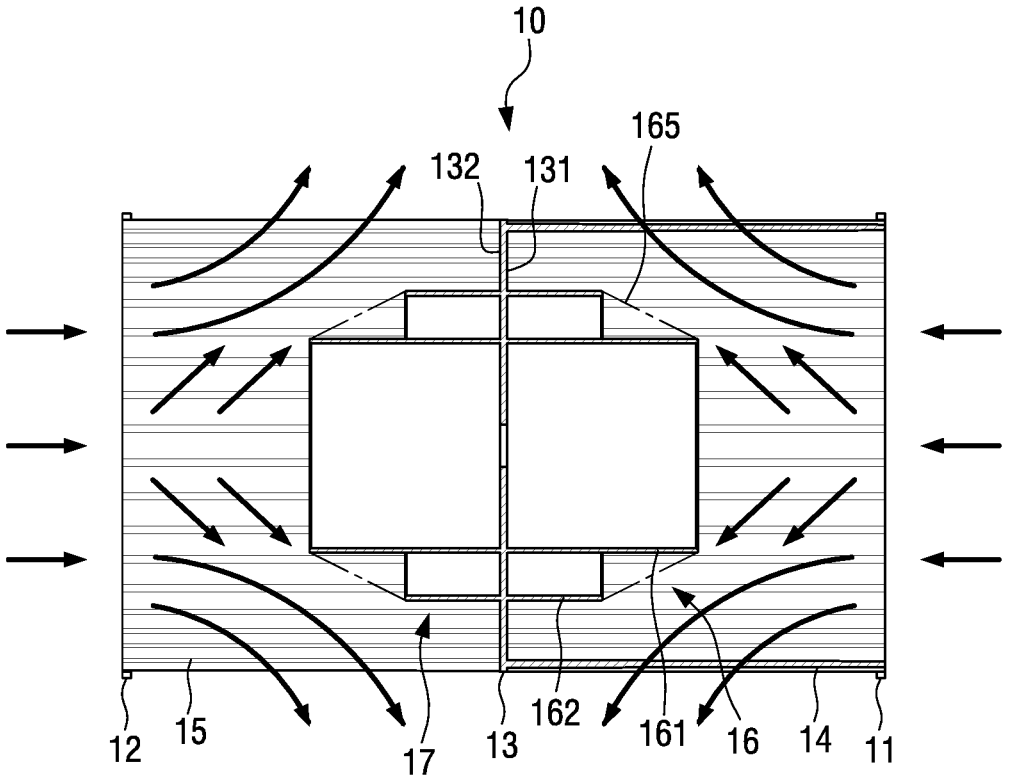
FIG. 4 is a view illustrating the shape of a rotating hub and air flow when the double suction fan of FIG. 1 rotates.

Thus, when the double suction fan 10 rotates, the first circular pipe 161 and the second circular pipe 162 form a virtual three-dimensional shape with a high center portion and a low edge portion. In detail, when the double suction fan 10 rotates, a part of the air introduced through the first ring 11 is stagnant and does not flow in the inside of the first circular pipe 161 and a space between the first circular pipe 161 and the second circular pipe 162, and is rotated together with the double suction fan 10. For example, the plurality of hub plates 161 and 162, that is, the first circular pipe 161 and the second circular pipe 162 may perform the function of a three-dimensional shape having a cross-section as illustrated in FIG. 4. Therefore, the remainder of the air introduced through the first ring 11 may not enter the inside of the first circular pipe 161 and the space between the first circular pipe 161 and the second circular pipe 162, but be evenly distributed in the longitudinal direction of the first blades 14 along the contour 165 formed when the first circular pipe 161 and the second circular pipe 162 rotate. Here, FIG. 4 is a view illustrating the shape of rotating hubs 16 and 17 and the air flow when the double suction fan 10 of FIG. 1 rotates.

In addition, because the rotating hub 16 of the double suction fan 10 according to an embodiment of the disclosure is formed of the plurality of circular pipes 161 and 162 having a smooth shape without protrusions on the outer surface thereof, the rotating hub 16 does not interfere with the core 510 (see FIG. 5) when the double suction fan 10 is manufactured through the injection process. This will be described in detail with reference to FIG. 5.

Figure 5:
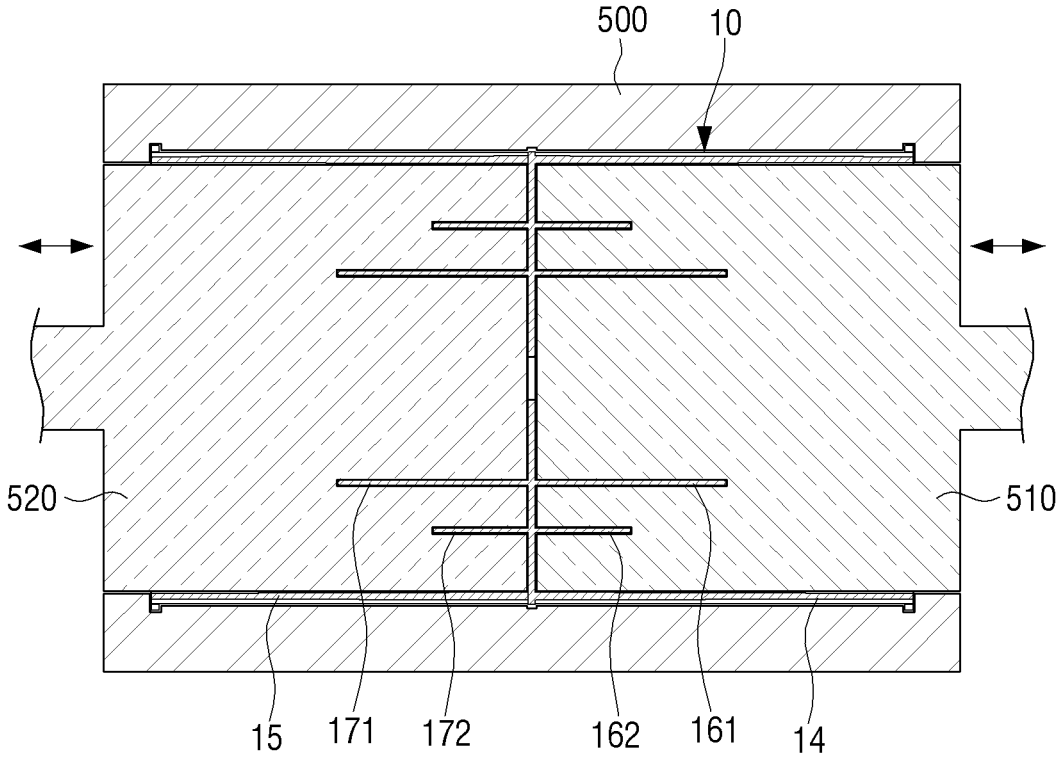
FIG. 5 is a cross-sectional view schematically illustrating a mold for injection molding a double suction fan according to a first embodiment of the disclosure.

FIG. 5 is a cross-sectional view schematically illustrating a mold for molding a double suction fan according to a first embodiment of the disclosure by injection.

Referring to FIG. 5, a fan mold 500 forms a space corresponding to the outer circumferential surface of the double suction fan 10, and cores 510 and 520 configured to form the plurality of blades 14 and 15 and the rotating hubs 16 and 17 are inserted into the space of the fan mold 500. For example, a first core 510 configured to form the plurality of first blades 14 and the first rotating hub 16, that is, the first and second circular pipes 161 and 162 is inserted into one space of the fan mold 500. A second core 520 configured to form the plurality of second blades 15 and the second rotating hub 17, that is, the third and fourth circular pipes 171 and 172 is inserted into the other space of the fan mold 500.

Therefore, the double suction fan 10 is molded by filling a resin into the cavity formed by the fan mold 500, the first core 510, and the second core 520. Thereafter, when the first core 510 and the second core 520 move in the longitudinal direction of the first blades 14 and the second blades 15, the first and second cores 510 and 520 may exit from the plurality of first blades 14 and the plurality of second blades 15. At this time, the plurality of circular pipes 161, 162, 171 and 172 forming the rotating hubs 16 and 17 have no protrusions or undercuts on the outer surface that interfere with the first and second cores 510 and 520 moving in the longitudinal direction of the blades 14 and 15. Therefore, the double suction fan 10 may be easily manufactured through the injection process.

As described above, in the double suction fan 10 according to an embodiment of the disclosure, the first rotating hub 16 and the second rotating hub 17 formed on the intermediate plate 13 may evenly distribute the air introduced through the first ring 11 and the second ring 12 in the longitudinal direction of the first blades 14 and the second blades 15. In addition, because the plurality of hub plates 161 and 162 forming the rotating hubs 16 and 17 do not interfere with the first and second cores 510 and 520 (see FIG. 5), the double suction fan 10 according to an embodiment of the disclosure may be manufactured through the injection process, thereby reducing the manufacturing cost.

Hereinafter, a double suction fan according to a second embodiment of the disclosure will be described in detail with reference to FIGS. 6 to 9.

Figure 6:
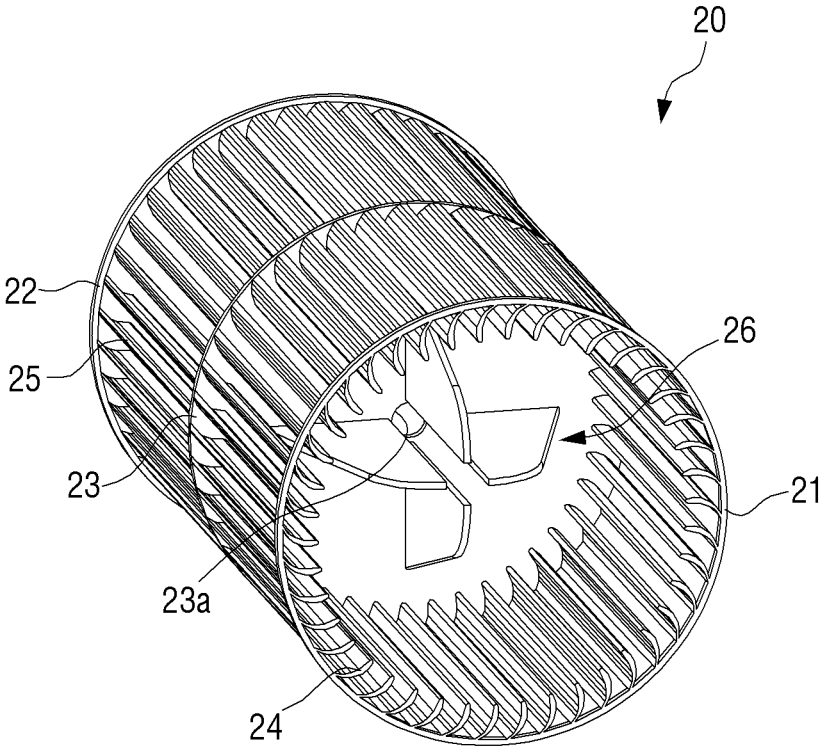
FIG. 6 is a perspective view illustrating a double suction fan according to a second embodiment of the disclosure.
Figure 7:
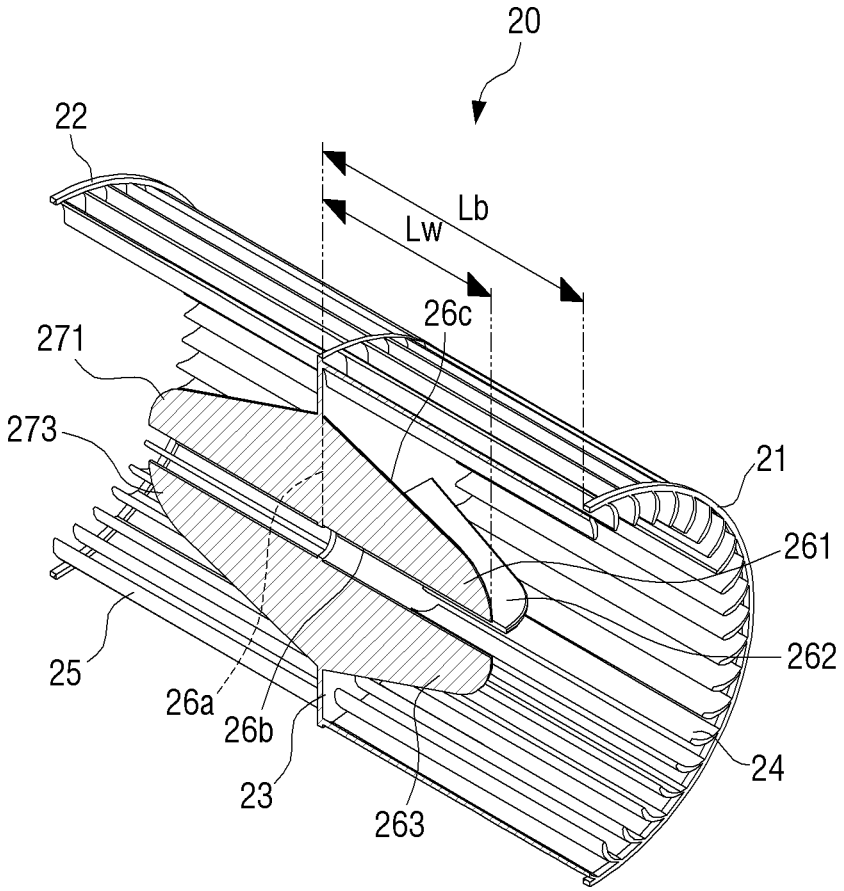
FIG. 7 is a cross-sectional view illustrating the double suction fan of FIG. 6.
Figure 8:
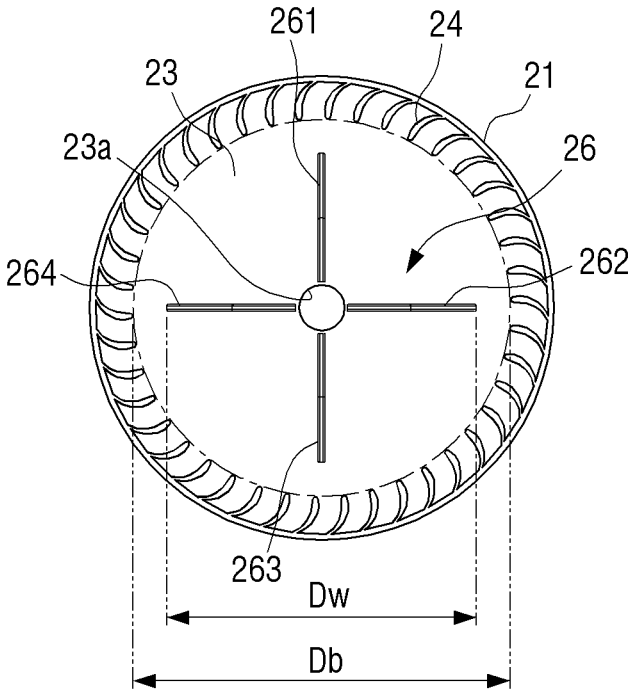
FIG. 8 is a side view illustrating the double suction fan of FIG. 6.
Figure 9:
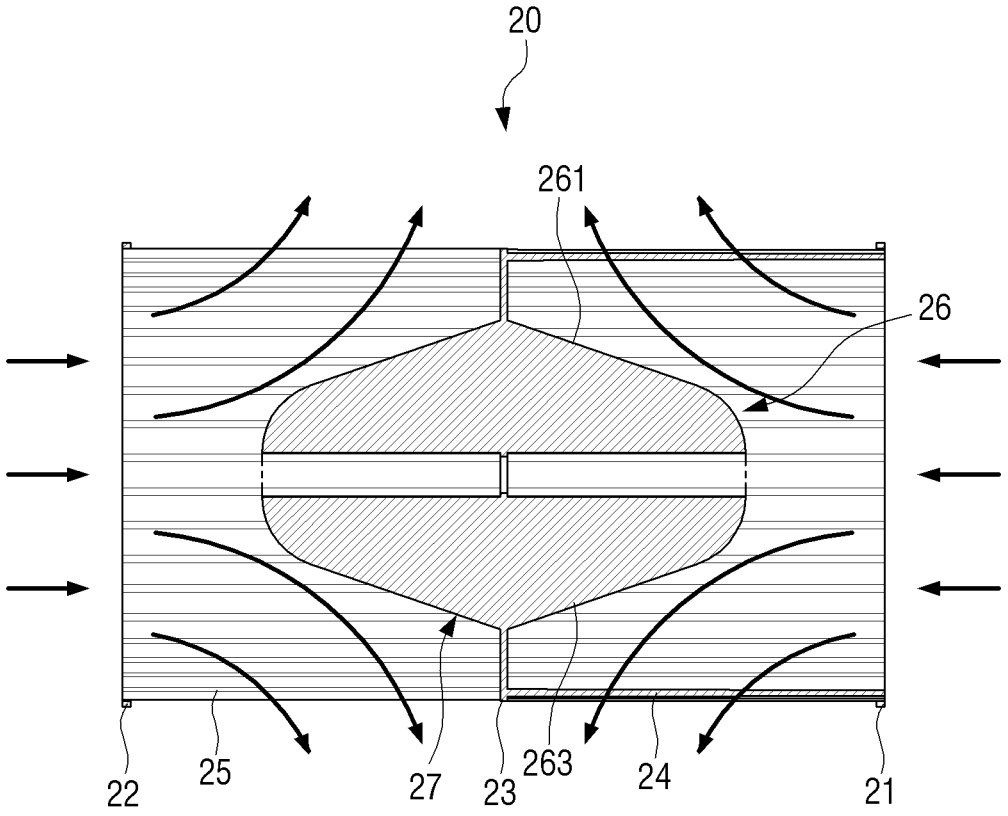
FIG. 9 is a view illustrating the shape of a rotating hub and air flow when the double suction fan of FIG. 6 rotates.

FIG. 6 is a perspective view illustrating a double suction fan according to a second embodiment of the disclosure. FIG. 7 is a cross-sectional view illustrating the double suction fan of FIG. 6, and FIG. 8 is a side view illustrating the double suction fan of FIG. 6. FIG. 9 is a view illustrating the shape of a rotating hub and air flow when the double suction fan of FIG. 6 rotates.

Referring to FIGS. 6, 7, and 8, a double suction fan 20 according to an embodiment of the disclosure may include a pair of rings 21 and 22, an intermediate plate 23, a plurality of blades 24 and 25, and rotating hubs 26 and 27.

The pair of rings 21 and 22, the intermediate plate 23, and the plurality of blades 24 and 25 are the same as or similar to the pair of rings 11 and 12, the intermediate plate 13, and the plurality of blades 14 and 15 of the double suction fan 10 according to the first embodiment of the disclosure as described above; therefore, detailed descriptions thereof are omitted.

The rotating hubs 26 and 27 may be provided at both side surfaces of the intermediate plate 23. The rotating hubs 26 and 27 may be configured to evenly distribute the air, which is introduced through the pair of rings 21 and 22 when the double suction fan 20 is rotated by a motor, in the longitudinal direction of the plurality of blades 24 and 25.

In detail, a first rotating hub 26 may be disposed on one surface of the intermediate plate 23, for example, on one surface of the intermediate plate 23 facing the first ring 21, and a second rotating hub 27 may be disposed on an opposite surface of the intermediate plate 23, for example, one surface of the intermediate plate 23 facing the second ring 22. Because the first rotating hub 26 and the second rotating hub 27 have the same structure, only the first rotating hub 26 will be described in detail. However, hereinafter, the first rotating hub 26 will be referred to as the rotating hub 26 for convenience of description.

The rotating hub 26 may be formed of a plurality of hub plates 261, 262, 263, and 264 which are disposed perpendicular to the intermediate plate 23 around a shaft hole 23*a*. In this case, the plurality of hub plates 261, 262, 263, and 264 are formed to evenly distribute the air introduced through the first ring 21 in the longitudinal direction of the plurality of first blades 24 when the intermediate plate 23 rotates. In addition, each of the plurality of hub plates 261, 262, 263, and 264 is formed in a smooth shape without protrusions on the outer surface thereof.

To this end, the plurality of hub plates 261, 262, 263, and 264 may be formed such that the virtual contour formed by the plurality of hub plates 261, 262, 263, and 264 when the intermediate plate 23 rotates has a high center portion and a lower edge portion.

For example, as illustrated in FIGS. 6 to 8, the plurality of hub plates 261, 262, 263, and 264 may include a plurality of wing plates 261, 262, 263, and 264 disposed radially at regular intervals on the intermediate plate 23 about the shaft hole 23*a*. Each of the plurality of wing plates 261, 262, 263, and 264 may be formed in a flat plate shape having a high height at one end close to the shaft hole 23*a* and a low height at the other end that is far from the shaft hole 23*a* and close to the blades 24.

In the embodiment as illustrated in FIGS. 6 to 8, the plurality of hub plates 261, 262, 263, and 264 includes four wing plates 261, 262, 263, and 264 arranged at 90 degree intervals. In other words, the four wing plates 261, 262, 263, and 264 forming the rotating hub 26 are arranged in a cross shape around the shaft hole 23*a*.

Referring to FIG. 7, each of the plurality of wing plates 261, 262, 263, and 264 includes a bottom edge 26*a* disposed on the intermediate plate 23 and a vertical edge 26*b* perpendicular to the bottom edge 26*a*, that is, to the intermediate plate 23. At this time, the bottom edge 26*a* and the vertical edge 26*b* are connected to each other by a curved surface. In other words, the side edge 26*c* which connects the lead end of the bottom edge 26*a* and the lead end of the vertical edge 26*b* may be formed in a curved surface. The curved surface may be formed in any curve as long as it can evenly distribute the introduced air in the longitudinal direction of the blade 24. For example, the curve may be formed in an arc. Alternatively, as illustrated in FIG. 7, the side edge 26*c* may be formed in a curve such that two wing plates 261, 263, and 262, 264 positioned on the same plane form a cross-section of a substantially bell shape. In other words, each of the side edges 26*c* of the wing plates 261, 262, 263, and 264 may have a curve surface that forms a virtual three-dimensional shape with a high center portion and a low edge portion.

On the other hand, the lengths of the plurality of wing plates 261, 262, 263, and 264 may be defined in a range of ⅓ to ⅔ of the length Lb of the first blade 14. In addition, the maximum length Dw of the two wing plates 261 and 263 forming a straight line may be defined in a range of ⅓ to ⅘ of the diameter Db of the virtual inner circle formed by the plurality of first blades 24. In this case, the curve of the side surface connecting the upper end and the lower end of the wing plate may be defined so that the contour formed by the plurality of wing plates 261, 262, 263, and 264 properly distributes the air flow when the double suction fan 20 rotates.

Accordingly, when the double suction fan 20 rotates, the plurality of wing plates 261, 262, 263, and 264 form a virtual three-dimensional shape with a high center portion and a low edge portion. In detail, when the double suction fan 20 rotates, a part of the air introduced into the first ring 21 is stagnant and does not flow in the space between the four wing plates 261, 262, 263, and 264, and is rotated together with the double suction fan 20. For example, the plurality of hub plates, that is, four wing plates 261, 262, 263, and 264 perform the function of a three-dimensional shape having the cross-section as illustrated in FIG. 9. Therefore, the remainder of the air introduced into the first ring 21 is not introduced into the space between the four wing plates 261, 262, 263, and 264, but evenly distributed in the longitudinal direction of the first blades 24 along the contour formed by the rotation of the four wing plates 261, 262, 263, and 264.

In addition, in the double suction fan 20 according to an embodiment of the disclosure, the plurality of wing plates 261, 262, 263, and 264 constituting the rotating hub 26 are flat plates; therefore, the rotating hub 26 has a smooth shape without protrusions or undercuts in the longitudinal direction of the plurality of blades 24 and 25. Therefore, when manufacturing the double suction fan 20 through the injection process, the rotating hub 26 does not interfere with the hub core.

In the embodiment as illustrated in FIGS. 6 to 8, the plurality of hub plates includes four wing plates 261, 262, 263, and 264 arranged in a cross shape. However, the number of the wing plates 261, 262, 263, and 264 is not limited thereto. In other words, five or more wing plates may be provided radially about the shaft hole 23*a* at regular intervals as the rotating hub 26 in the intermediate plate 23.

Hereinafter, a double suction fan according to a third embodiment of the disclosure will be described in detail with reference to FIGS. 10 to 13.

Figure 10:
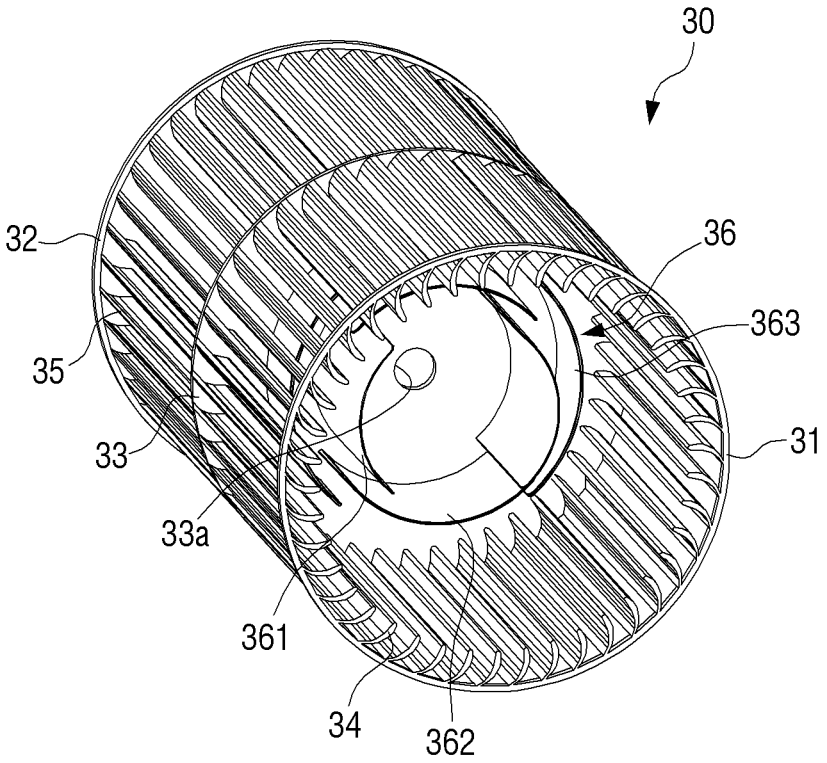
FIG. 10 is a perspective view illustrating a double suction fan according to a third embodiment of the disclosure.
Figure 11:
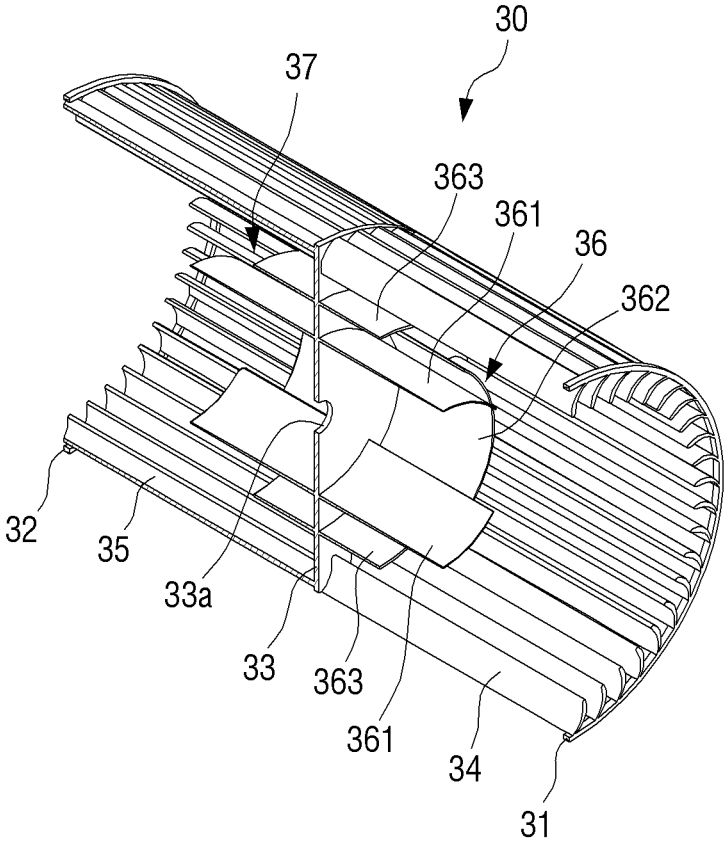
FIG. 11 is a cross-sectional view illustrating the double suction fan of FIG. 10.
Figure 12:
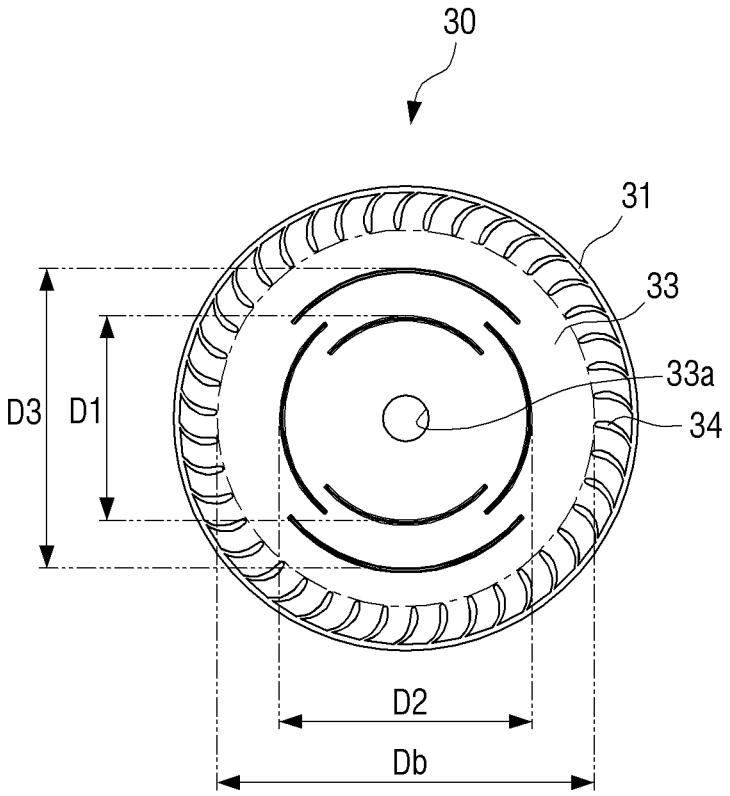
FIG. 12 is a side view illustrating the double suction fan of FIG. 10.
Figure 13:
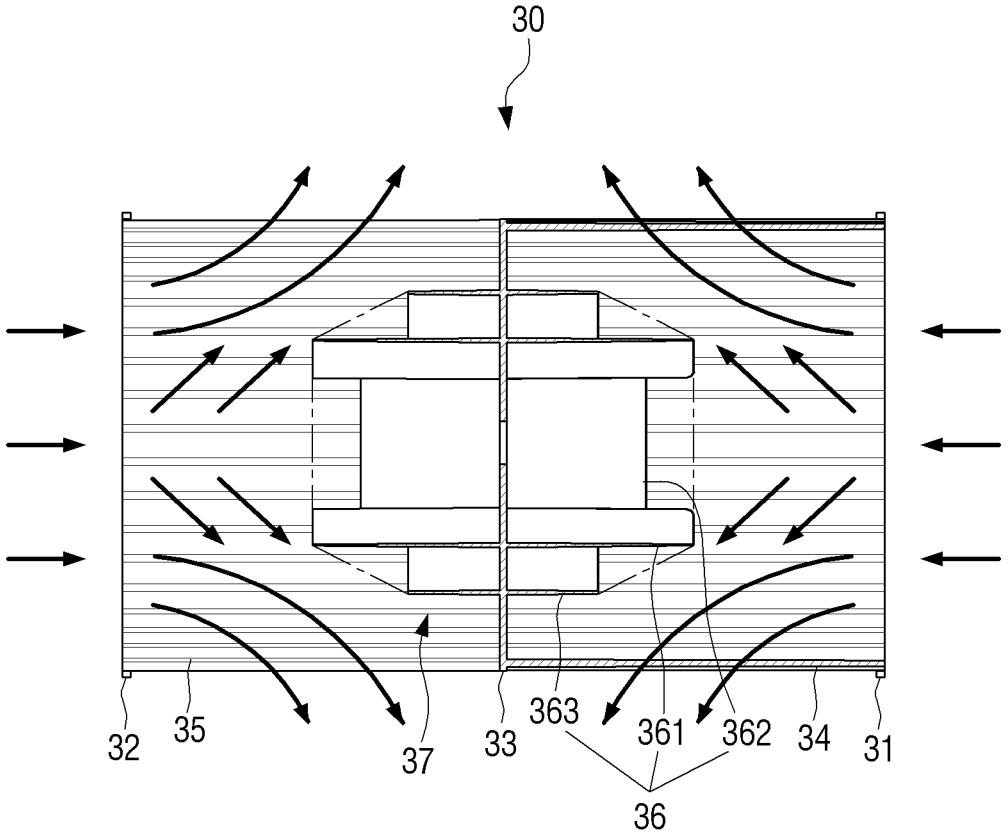
FIG. 13 is a view illustrating the shape of a rotating hub and air flow when the double suction fan of FIG. 10 rotates.

FIG. 10 is a perspective view illustrating a double suction fan according to a third embodiment of the disclosure. FIG. 11 is a cross-sectional view illustrating the double suction fan of FIG. 10, and FIG. 12 is a side view illustrating the double suction fan of FIG. 10. FIG. 13 is a view illustrating the shape of a rotating hub and air flow when the double suction fan of FIG. 10 rotates.

Referring to FIGS. 10 to 12, a double suction fan 30 according to an embodiment of the disclosure may include a pair of rings 31 and 32, an intermediate plate 33, a plurality of blades 34 and 35, and rotating hubs 36 and 37.

The pair of rings 31 and 32, the intermediate plate 33, and the plurality of blades 34 and 35 are the same as or similar to the pair of rings 11 and 12, the intermediate plate 13, and the plurality of blades 14 and 15 of the double suction fan 10 according to the first embodiment of the disclosure as described above; therefore, detailed descriptions thereof are omitted.

The rotating hubs 36 and 37 may be provided on both side surfaces of the intermediate plate 33. The rotating hubs 36 and 37 may be configured to evenly distribute the air, which is introduced through the pair of rings 31 and 32 when the double suction fan 30 is rotated by a motor, in the longitudinal direction of the plurality of blades 34 and 35.

In detail, a first rotating hub 36 may be disposed on one surface of the intermediate plate 33, for example, a surface of the intermediate plate 33 facing the first ring 31. A second rotating hub 37 may be disposed on an opposite surface of the intermediate plate 33, for example, on a surface of the intermediate plate 33 facing the second ring 32. The first rotating hub 36 and the second rotating hub 37 have the same structure; therefore, only the first rotating hub 36 will be described in detail. However, the first rotating hub 36 will be referred to as the rotating hub 36 for convenience of description.

The rotating hub 36 may be formed in a plurality of hub plates 361, 362, and 363 which are disposed perpendicular to the intermediate plate 33 around the shaft hole 33*a*. The plurality of hub plates 361, 362, and 363 are formed to evenly distribute the air introduced through the first ring 31 in the longitudinal direction of the plurality of first blades 34 when the intermediate plate 33 rotates. In addition, each of the plurality of hub plates 361, 362, and 363 is formed in a smooth shape without protrusions on the outer surface thereof.

To this end, the plurality of hub plates 361, 362, and 363 may be formed so that the imaginary contour formed by the plurality of hub plates 361, 362, and 363 when the intermediate plate 33 rotates forms a shape having a high center portion and a low edge portion.

For example, as illustrated in FIGS. 10 to 12, the plurality of hub plates 361, 362, and 363 may include a plurality of arc plates 361, 362, and 363 disposed concentrically on the intermediate plate 33 about the shaft hole 33*a*. At this time, the length of the plurality of arc plates 361, 362, and 363 is formed to become shorter from the center to the edge. In other words, the length of the arc plate 361 closest to the shaft hole 33*a* is the longest, and the length of the arc plate 363 closest to the plurality of blades 34 is shortest. The arc plate 362 positioned therebetween has a length in the middle thereof.

For example, the plurality of hub plates 361, 362, and 363 disposed on the intermediate plate 33 may include a pair of first arc plates 361, a pair of second arc plates 362, and a pair of third arc plates 363.

The pair of first arc plates 361 are symmetrically arranged about the shaft hole 33*a*. The pair of first arc plates 361 may be formed to have the substantially same curvature as the outer circumferential surface of the intermediate plate 33. The pair of first arc plates 361 are formed in the same size and are provided at the same distance from the shaft hole 33*a*.

The pair of second arc plates 362 are provided on the outside of the pair of first arc plates 361 concentrically with the pair of first arc plates 361. In addition, the pair of the second arc plates 362 are disposed perpendicular to the pair of the first arc plates 361. Therefore, the pair of second arc plates 362 are positioned at portions that are not covered by the pair of first arc plates 361, that is, at both sides of the pair of first arc plates 361. In this case, both end portions of the pair of second arc plates 362 may be provided to overlap a predetermined length with both end portions of the pair of first arc plates 361.

The pair of third arc plates 363 are concentric with the pair of first arc plates 361 and are disposed perpendicular to the pair of second arc plates 362 on the outside of the pair of second arc plates 362. In other words, the pair of third arc plates 363 are spaced apart from the pair of first arc plates 361 by a predetermined distance and overlap the pair of first arc plates 361. Therefore, the pair of third arc plates 363 are positioned at portions that are not covered by the pair of second arc plates 362, that is, at both sides of the pair of second arc plates 362. In this case, both end portions of the pair of third arc plates 363 may be provided to overlap a predetermined length with both end portions of the pair of second arc plates 362. Therefore, as illustrated in FIG. 12, the width of the third arc plate 363 may be greater than the width of the first arc plate 361.

Further, the length of the first arc plate 361 is formed the longest, and the length of the third arc plate 363 is formed the shortest. In other words, the length of the first arc plate 361 close to the shaft hole 33*a* is the longest, and the length of the third arc plate 363 far from the shaft hole 33*a* and close to the blades 34 is the shortest. The length of the second arc plate 362 positioned between the first arc plate 361 and the third arc plate 363 is shorter than the length of the first arc plate 361 and longer than the length of the third arc plate 363. For example, the length of the first arc plate 361 may be defined in a range of ⅓ to ⅔ of the length of the first blades 34.

In addition, the outer diameter D3 of the third arc plates 363 may be defined in a range of ⅓ to ⅘ of the diameter Db of the virtual inner circle formed by the plurality of first blades 34. In this case, the outer diameter D2 of the second arc plates 362 is defined to be smaller than the outer diameter D3 of the third arc plates 363 so that the second arc plates 362 are spaced apart from the third arc plates 363. The outer diameter D1 of the first arc plates 361 is defined to be smaller than the outer diameter D2 of the second arc plates 362 so that the first arc plates 361 are spaced apart from the second arc plates 362. At the same time, the outer diameters D1 and D2 of the first arc plates 361 and the second arc plates 362 and the lengths of the second arc plates 362 and the third arc plates 363 may be defined so that the contour formed by the first arc plates 361, the second arc plates 362, and the third arc plates 363 properly distributes the air flow when the double suction fan 30 rotates.

Therefore, when the double suction fan 30 rotates, the plurality of arc plates 361, 362, and 363 form a virtual three-dimensional shape with a high center portion and a low edge portion. In detail, when the double suction fan 30 rotates, a portion of the air introduced into the first ring 31 is stagnant and does not flow in the space between the plurality of arc plates 361, 362, and 363, and is rotated together with the double suction fan 30. For example, the plurality of hub plates, that is, three pairs of arc plates 361, 362, and 363 perform a function of the three-dimensional shape having the cross-section as illustrated in FIG. 13. Therefore, the remainder of the air introduced into the first ring 31 may not be introduced into the space between the three pairs of arc plates 361, 362, and 363, but may be evenly distributed in the longitudinal direction of the first blades 34 along the contour formed by the rotation of the three pairs of arc plates 361, 362, and 363.

In addition, in the double suction fan 30 according to an embodiment of the disclosure, the plurality of arc plates 361, 362, and 363 constituting the rotating hub 36 are curved plates which form a straight line in the longitudinal direction of the plurality of blades 34 and 35; therefore, the rotating hub 36 has a smooth shape without protrusions or undercuts in the longitudinal direction of the plurality of blades 34 and 35. Thus, when manufacturing the double suction fan 30 though the injection process, the rotating hub 36 does not interfere with a core configured to form the rotating hub 36.

In the embodiment as illustrated in FIGS. 10 to 12, the plurality of arc plates includes three pairs of arc plates 361, 362, and 363 arranged at predetermined intervals in the radial direction. However, the number of the plurality of arc plates 361, 362, and 363 is not limited thereto. In other words, although not illustrated, two pairs of arc plates or four or more pairs of arc plates may be provided on the intermediate plate 33 as the rotating hub 36.

Hereinafter, a double suction fan according to a fourth embodiment of the disclosure will be described in detail with reference to FIGS. 14 to 16.

Figure 14:
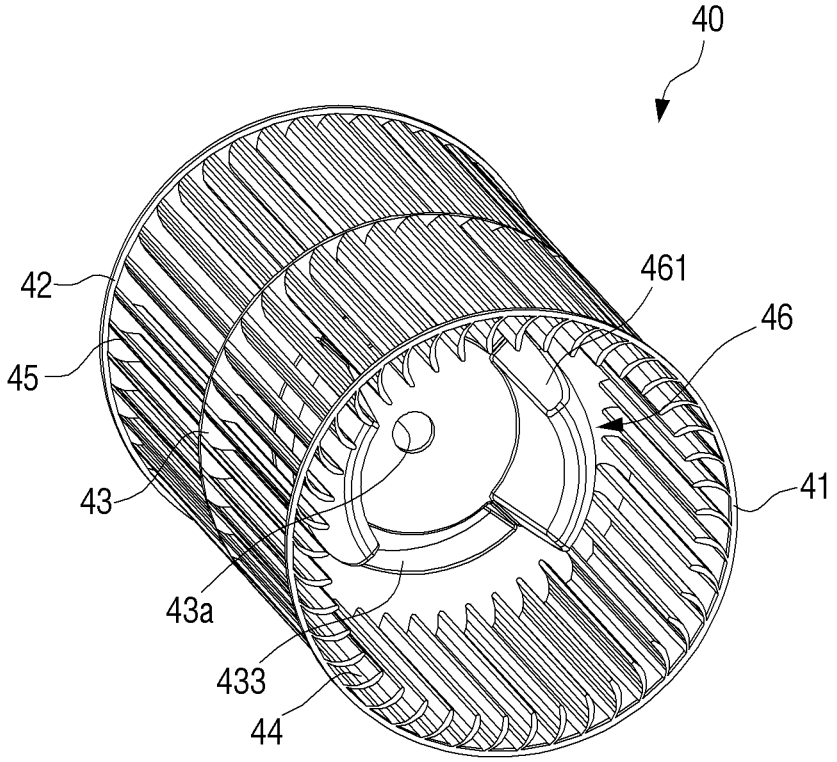
FIG. 14 is a perspective view illustrating a double suction fan according to a fourth embodiment of the disclosure.

FIG. 14 is a perspective view illustrating a double suction fan according to a fourth embodiment of the disclosure. FIG. 15 is a cross-sectional view illustrating the double suction fan of FIG. 14, and FIG. 16 is a side view illustrating the double suction fan of FIG. 14.

Figure 15:
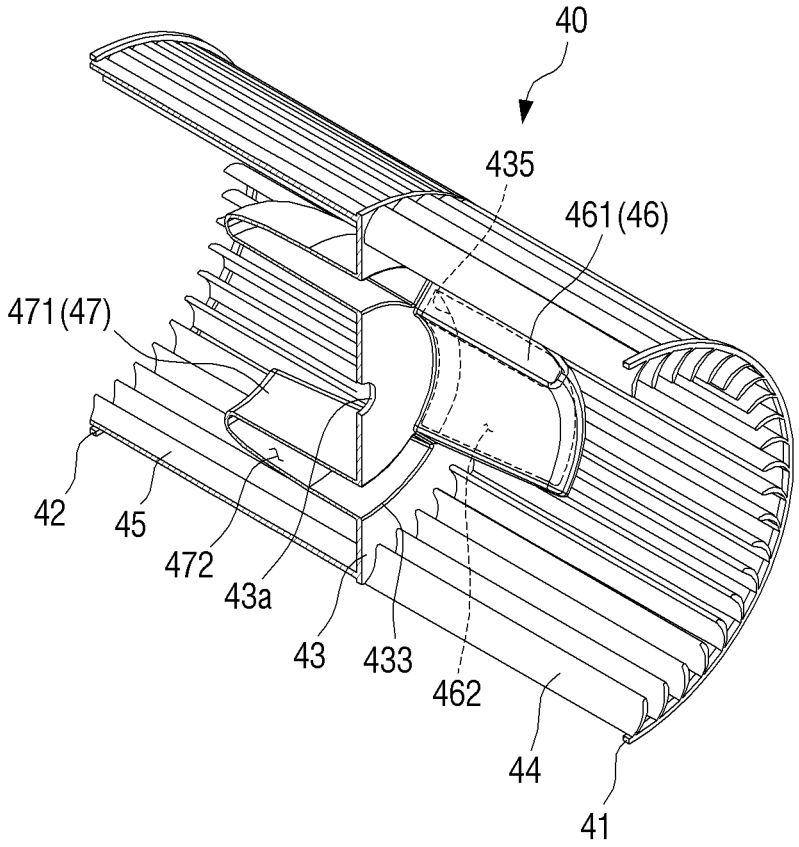
FIG. 15 is a cross-sectional view illustrating the double suction fan of FIG. 14.
Figure 16:
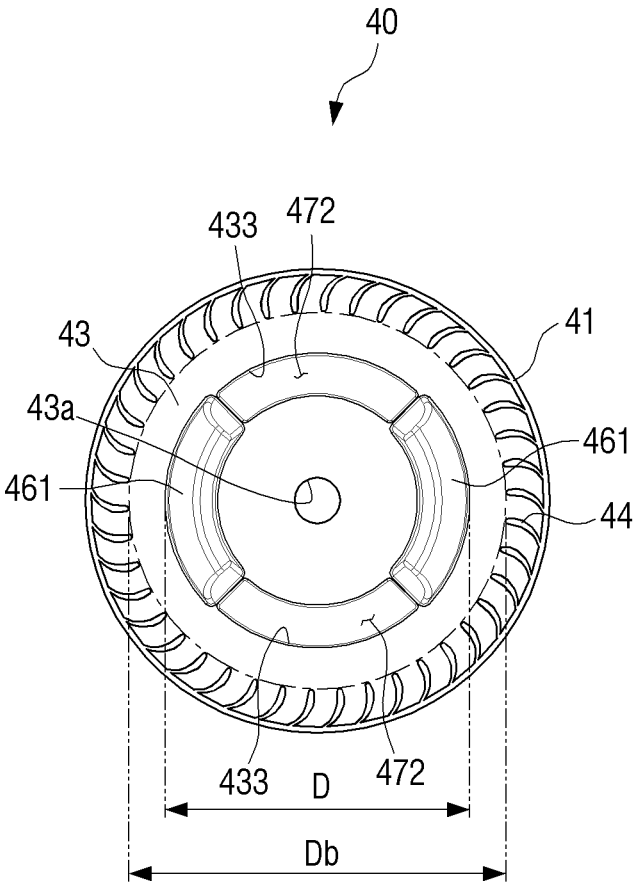
FIG. 16 is a side view illustrating the double suction fan of FIG. 14.

Referring to FIGS. 14, 15, and 16, a double suction fan 40 according to an embodiment of the disclosure may include a pair of rings 41 and 42, an intermediate plate 43, a plurality of blades 44 and 45, and rotating hubs 46 and 47.

The pair of rings 41 and 42, the intermediate plate 43, and the plurality of blades 44 and 45 are the same as or similar to the pair of rings 11 and 12, the intermediate plate 13, and the plurality of blades 14 and 15 of the double suction fan 10 according to the first embodiment of the disclosure as described above; therefore, detailed descriptions thereof are omitted.

The rotating hubs 46 and 47 may be provided on both side surfaces of the intermediate plate 43. The rotating hubs 46 and 47 may be configured to evenly distribute the air, which is introduced through the pair of rings 41 and 42 when the double suction fan 40 is rotated by a motor, in the longitudinal direction of the plurality of blades 44 and 45.

In detail, a first rotating hub 46 may be disposed on one surface of the intermediate plate 43, for example, a surface of the intermediate plate 43 facing the first ring 41. A second rotating hub 47 may be disposed on an opposite surface of the intermediate plate 43, for example, on a surface of the intermediate plate 43 facing the second ring 42. The first rotating hub 46 and the second rotating hub 47 have the same structure; therefore, only the first rotating hub 46 will be described in detail. However, the first rotating hub 46 will be referred to as the rotating hub 46 for convenience of description.

The rotating hub 46 may be formed of a plurality of hub plates 461 which are disposed perpendicular to the intermediate plate 43 around the shaft hole 43*a*. The plurality of hub plates 461 are formed to evenly distribute the air introduced through the first ring 41 in the longitudinal direction of the plurality of first blades 44 when the intermediate plate 43 rotates. In addition, each of the plurality of hub plates 461 is formed in a smooth shape without protrusions on the outer surface thereof.

To this end, the plurality of hub plates 461 may be formed so that the imaginary contour formed by the plurality of hub plates 461 when the intermediate plate 43 rotates has a high center portion and a low edge portion.

For example, as illustrated in FIGS. 14, 15, and 16, the plurality of hub plates 461 may include a plurality of arc walls 461 disposed concentrically on the intermediate plate 43 about the shaft hole 43*a*. The double suction fan 40 according to the present embodiment has a structure similar to the double suction fan 30 having the arc plates 361, 362, and 363 as described above. However, the arc plates 361, 362, and 363 of the above-described embodiment are formed of thin curved plates, but the arc walls 461 of the present embodiment are thicker than the arc plates 361, 362, and 363, and have a cavity 462 therein.

In addition, the double suction fan 40 according to the present embodiment is formed so that a plurality of first arc walls 461 provided on a first side surface of the intermediate plate 43 in which a plurality of first blades 44 are disposed and a plurality of second arc walls 471 provided on a second side surface of the intermediate plate 43 in which a plurality of second blades 45 are disposed are formed to cross each other. As described above, when the plurality of first arc walls 461 and the plurality of second arc walls 471 provided on both side surfaces of the intermediate plate 43 are not positioned at the same position but intersect with each other, cavities 462 and 472 may be formed inside the first and second arc walls 461 and 471 by using a core during the injection molding.

Further, each of the plurality of arc walls 461 and 471 may be formed in a shape in which the thickness thereof gradually decreases upward from the bottom fixed to the intermediate plate 43.

Referring to FIGS. 14 to 16, the plurality of arc walls may include a pair of first arc walls 461 formed to face each other on the first side surface of the intermediate plate 43 and a pair of second arc walls 471 formed to face each other on the second side surface of the intermediate plate 43. In this case, the pair of first arc walls 461 and the pair of second arc walls 471 are disposed along an imaginary circle having the same diameter. The pair of second arc walls 471 are formed at portions of the second side surface corresponding to portions of the first side surface of the intermediate plate 43 on which the pair of first arc walls 461 are not formed.

In addition, the first side surface of the intermediate plate 43 may be provided with a pair of first openings 433 in communication with the cavities 472 of the pair of second arc walls 471, and the second side surface of the intermediate plate 43 may be provided with a pair of second openings 435 in communication with the cavities 462 of the pair of first arc walls 461. Accordingly, the pair of first arc walls 461 and the pair of first openings 433 are alternately arranged on the first side surface of the intermediate plate 43 to form a circle. Also, the pair of the second arc walls 471 and the pair of second openings 435 are alternately arranged on the second side surface of the intermediate plate 43 to form a circle.

In this case, the lengths of the pair of first and second arc walls 461 and 471 may be defined in a range of ⅓ to ⅔ of the length of the first blade 44. In addition, the outer diameter D of the pair of first and second arc walls 461 and 471 may be defined in a range of ⅓ to ⅘ of the diameter Db of the virtual inner circle formed by the plurality of first blades 44. At the same time, the lengths and outer diameters D of the pair of first and second arc walls 461 and 471 may be defined such that when the double suction fan 40 rotates, the contour formed by the pair of first and second arc walls 461 and 471 properly distributes the air flow.

On the other hand, the cavity 462 of the first arc wall 461 may be formed using a cavity core configured to be inserted through the second opening 435 formed in the second side surface of the intermediate plate 43. The cavity 472 of the second arc wall 471 may be formed using a cavity core 611 (see FIG. 17) configured to be inserted through the first opening 433 formed in the first side surface of the intermediate plate 43.

Figure 17:
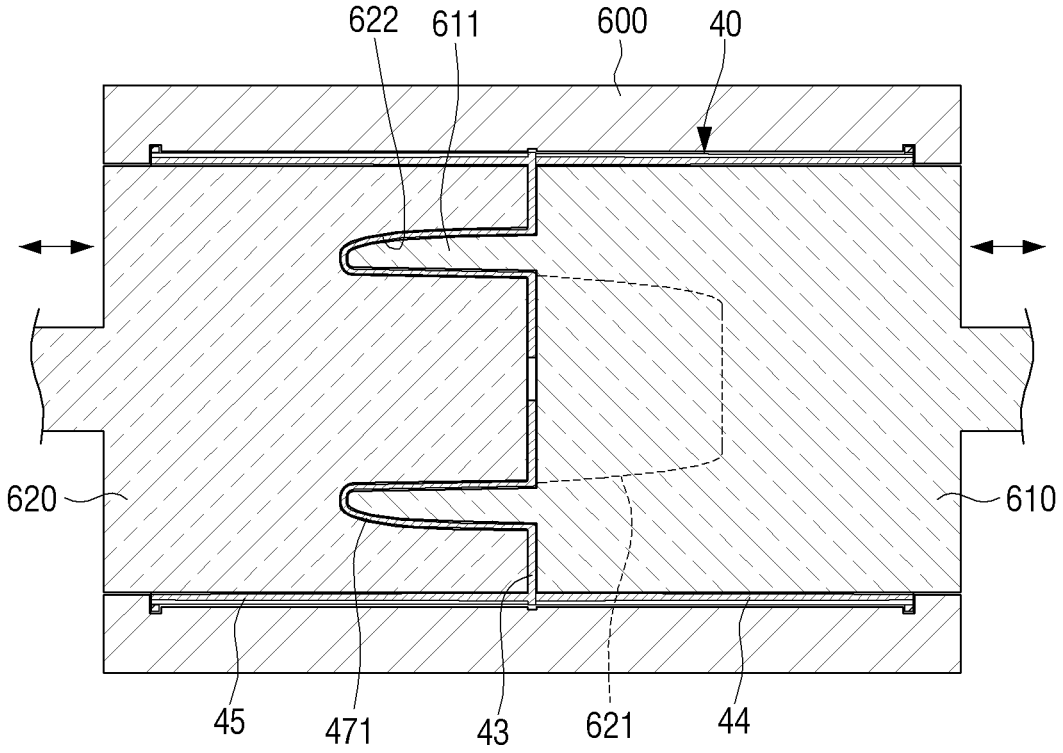
FIG. 17 is a cross-sectional view schematically illustrating a mold for injection molding a double suction fan according to a fourth embodiment of the disclosure.

FIG. 17 is a cross-sectional view schematically illustrating a mold for injection molding a double suction fan according to a fourth embodiment of the disclosure.

Referring to FIG. 17, a fan mold 600 forms a space corresponding to the outer circumferential surface of the double suction fan 40, and cores 610 and 620 configured to form the plurality of blades 44 and 45 and the rotating hubs 46 and 47 are inserted into the space of the fan mold 600. For example, a first core 610 configured to form the plurality of first blades 44 and the first rotating hub 46, that is, the pair of first arc walls 461 is inserted into one side space of the fan mold 600. A second core 620 configured to form the plurality of second blades 45 and the second rotating hub 47, that is, the pair of second arc walls 471 is inserted into the other side space of the fan mold 600. A pair of cavity cores 611 provided at the front end of the first core 610 are inserted into portions 622 forming the pair of second arc walls 471 of the second core 620. A pair of cavity cores provided at the front end of the second core 620 are inserted into portions 621 forming the pair of first arc walls of the first core 610.

Therefore, when the resin is filled in the cavity formed by the fan mold 600, the first core 610, and the second core 620, a double suction fan 40 having a plurality of blades 44 and 45 and a pair of arc walls 461 and 471 on both side surfaces of the intermediate plate 43 is molded as illustrated in FIG. 14. Subsequently, when the first core 610 and the second core 620 are moved in the longitudinal direction of the first blades 44 and the second blades 45, the first core 610 and the second core 620 may escape from the plurality of first blades 44 and the plurality of second blades 45. In this case, the outer surfaces of the pair of arc walls 461 and 471 forming the rotating hubs 46 and 47 has no protrusion or undercut that interferes with the first and second cores 610 and 620 moving in the longitudinal direction of the first and second blades 44 and 45; therefore, the rotating hubs 46 and 47 may be manufactured easily through the injection process.

As described above, in the double suction fan 40 according to an embodiment of the disclosure, the pair of first arc walls 461 and the second arc walls 471 formed on the intermediate plate 43 may equally distribute the air introduced into the first ring 41 and the second ring 42 in the longitudinal direction of the first blades 44 and the second blades 45. In addition, the plurality of arc walls 461 and 471 forming the rotating hubs 46 and 47 do not interfere with the cores 610 and 620. Thus, the double suction fan 40 according to an embodiment of the disclosure may be manufactured through an injection process; therefore, the manufacturing cost thereof may be reduced.

As such, when the rotating hubs 46 and 47 are formed of the arc walls 461 and 471 that are thicker than the arc plates 361, 362, and 363 of the double suction fan 30 according to the above-described embodiment and have the cavities 462 and 472, the rotating hubs 46 and 47 may have the rigidity larger than that of the arc plates 361, 362, and 363. Therefore, the double suction fan 40 may secure sufficient rigidity to withstand the strong centrifugal force applied to the rotating hubs 46 and 47 when rotating at a high speed. In addition, because the arc walls 461 and 471 are alternately arranged in the circumferential direction on both side surfaces of the intermediate plate 43, the weight balance problem may be solved.

When the double suction fan 40 having the above structure rotates, the plurality of arc walls 461 and 471 form a virtual three-dimensional shape having a high center portion and a low edge portion. In detail, when the double suction fan 40 rotates, a portion of the air introduced into the first ring 41 is stagnant and does not flow in the space between the plurality of arc walls 461, and is rotated together with the double suction fan 40. For example, the plurality of hub plates, that is, the pair of arc walls 461 perform the same function as the three-dimensional shape having the cross-section obtained by cutting the pair of arc walls 461. Therefore, the remainder of the air introduced into the first ring 41 may not be introduced into the space between the pair of first arc walls 461, but may be evenly distributed in the longitudinal direction of the first blades 44 along the contour formed by the rotation of the pair of first arc walls 461. The air introduced into the second ring 42 may also equally distributed in the longitudinal direction of the second blades 45 along the contour formed by the rotation of the pair of second arc walls 471.

In addition, in the double suction fan 40 according to an embodiment of the disclosure, the plurality of arc walls 461 and 471 constituting the rotating hubs 46 and 47 have a smooth shape without protrusions in the longitudinal direction of the plurality of blades 44 and 45. Thus, when manufacturing the double suction fan 40 though the injection process, the rotating hubs 46 and 47 do not interfere with cores.

In the above description, the rotating hubs 46 and 47 are formed of the pair of arc walls 461 and 471; however, the number of the arc walls forming the rotating hubs 46 and 47 is not limited thereto. As another example, the rotating hubs 46 and 47 may be formed of two or more pairs of arc walls provided on the intermediate plate 43.

Figure 18:
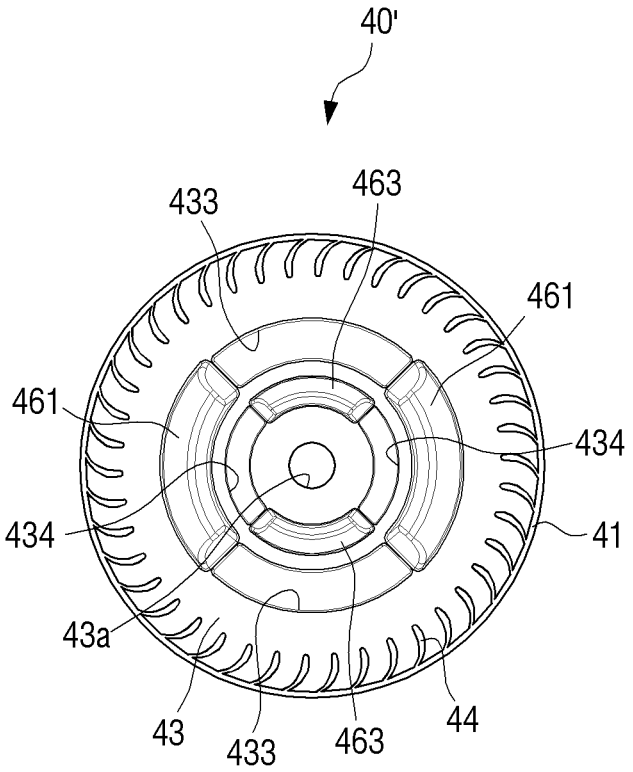
FIG. 18 is a side view illustrating a modification of the double suction fan of FIG. 14.

FIG. 18 is a side view illustrating a modification of the double suction fan of FIG. 14.

Referring to FIG. 18, a double suction fan 40' according to an embodiment of the disclosure may include two pairs of arc walls 461 and 463 provided on the intermediate plate 43.

In detail, the rotating hub 46 provided on the intermediate plate 43 may include a pair of inner arc walls 463 and a pair of outer arc wall 461.

The pair of inner arc walls 463 are symmetrically arranged about the shaft hole 43*a*. The pair of inner arc walls 463 may be formed to have the same curvature as the outer circumferential surface of the intermediate plate 43. The pair of inner arc walls 463 are formed in the same size and are provided at the same distance from the shaft hole 43*a*. A cavity is formed inside each of the pair of the inner arc walls 463. The first side surface of the intermediate plate 43 is provided with a pair of inner openings 434 in communication with the cavities of the pair of inner arc walls formed on the second side surface of the intermediate plate 43. Accordingly, the pair of inner arc walls 463 and the pair of inner openings 434 are alternatively arranged on the first side surface of the intermediate plate 43 to form a circle.

The pair of outer arc wall 461 are provided on the outer side of the pair of inner arc walls 463 concentrically with the pair of inner arc walls 463. Further, the pair of the outer arc walls 461 are disposed perpendicular to the pair of inner arc walls 463. Accordingly, the pair of outer arc walls 461 are positioned at portions that are not covered by the pair of the inner arc walls 463, that is, on both sides of the pair of inner arc walls 463. A cavity is provided inside each of the pair of outer arc walls 461. The first side surface of the intermediate plate 43 is provided with a pair of outer openings 433 in communication with the cavities of the pair of outer arc walls formed on the second side surface of the intermediate plate 43. Accordingly, on the first side surface of the intermediate plate 43, the pair of outer arc walls 461 and the pair of outer openings 433 are alternatively provided outside the pair of inner arc walls 463 and the pair of inner openings 434 to form a circle.

At this time, the lengths of the plurality of arc walls 461 and 463 are formed to become shorter from the center to the edge. In other words, the length of the inner arc wall 463 closest to the shaft hole 43*a* is long, and the length of the outer arc wall 461 closest to the plurality of blades 44 is short. Although not illustrated, in the case where a plurality of arc walls are formed in a triple circle shape, the intermediate arc walls positioned between the inner arc walls and the outer arc walls have a length between the length of the inner arc wall and the length of the outer arc wall.

Hereinafter, a double suction fan according to a fifth embodiment of the disclosure will be described in detail with reference to FIGS. 19 to 22.

Figure 19:
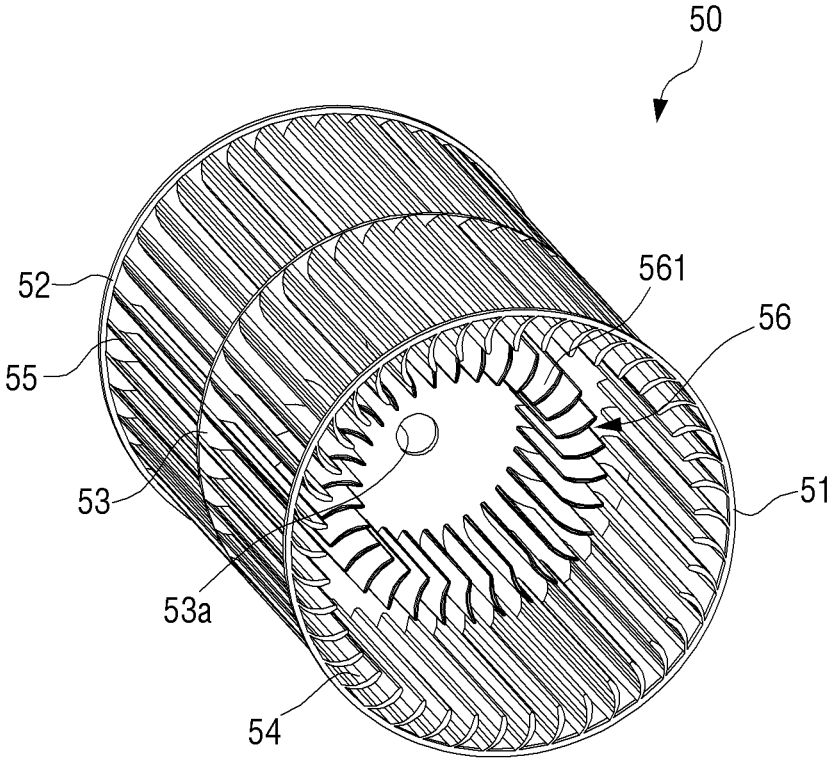
FIG. 19 is a perspective view illustrating a double suction fan according to a fifth embodiment of the disclosure.
Figure 20:
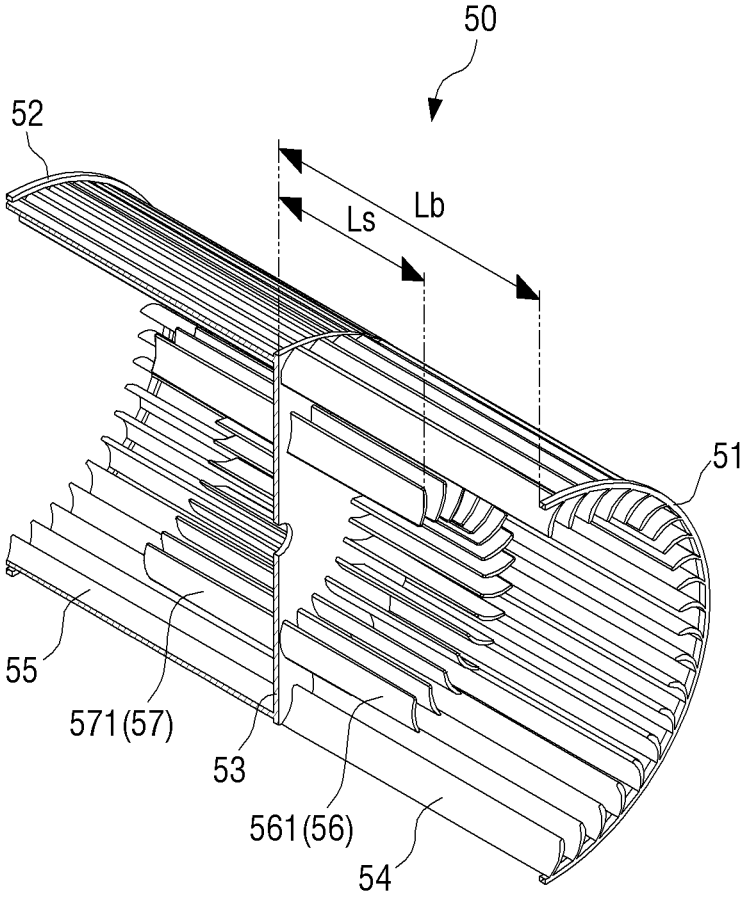
FIG. 20 is a cross-sectional view illustrating the double suction fan of FIG. 19.
Figure 21:
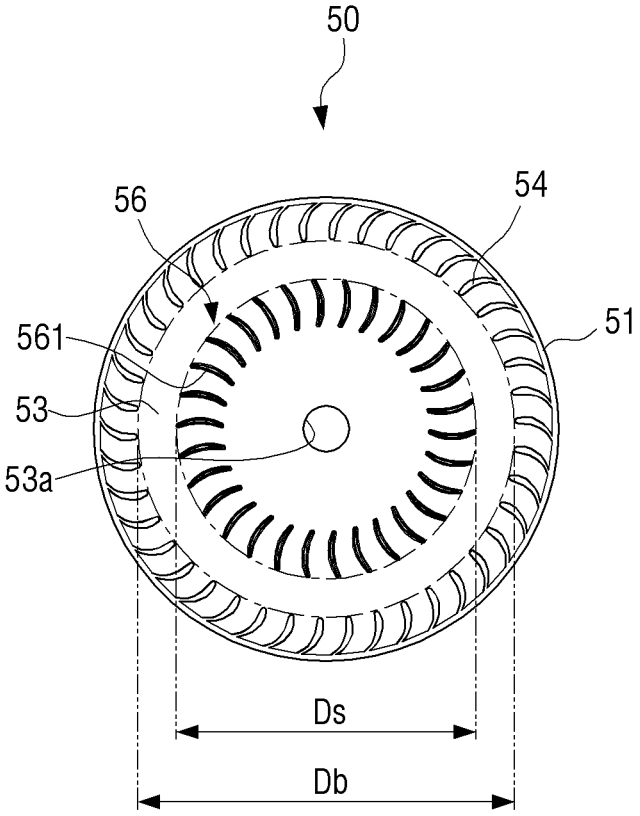
FIG. 21 is a side view illustrating the double suction fan of FIG. 19.
Figure 22:
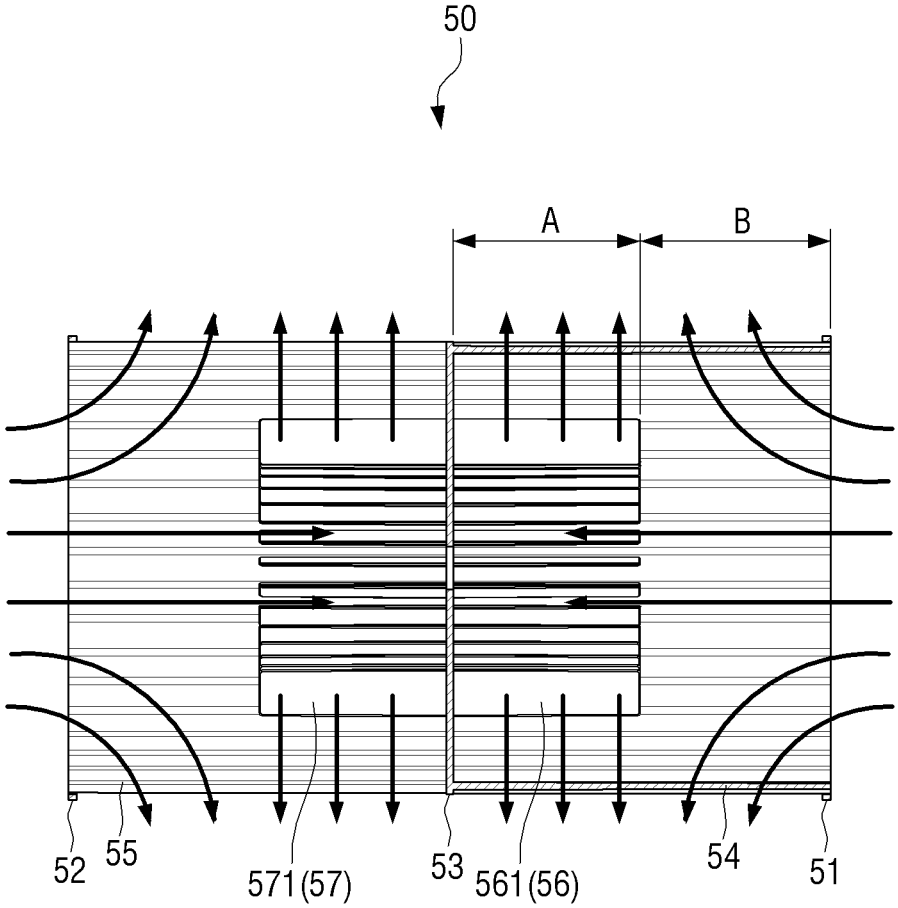
FIG. 22 is a view illustrating the shape of a rotating hub and air flow when the double suction fan of FIG. 19 rotates.

FIG. 19 is a perspective view illustrating a double suction fan according to a fifth embodiment of the disclosure. FIG. 20 is a cross-sectional view illustrating the double suction fan of FIG. 19, and FIG. 21 is a side view illustrating the double suction fan of FIG. 19. FIG. 22 is a view illustrating the shape of a rotating hub and air flow when the double suction fan of FIG. 19 rotates.

Referring to FIGS. 19 to 21, a double suction fan 50 according to an embodiment of the disclosure may include a pair of rings 51 and 52, an intermediate plate 53, a plurality of blades 54 and 55, and rotating hubs 56 and 57.

The pair of rings 51 and 52, the intermediate plate 53, and the plurality of blades 54 and 55 are the same as or similar to the pair of rings 11 and 12, the intermediate plate 13, and the plurality of blades 14 and 15 of the double suction fan 10 according to the first embodiment of the disclosure as described above; therefore, detailed descriptions thereof are omitted.

The rotating hubs 56 and 57 may be provided on both side surfaces of the intermediate plate 53. The rotating hubs 56 and 57 may be configured to evenly distribute the air, which is introduced through the pair of rings 51 and 52 when the double suction fan 50 is rotated by a motor, in the longitudinal direction of the plurality of blades 54 and 55.

In detail, a first rotating hub 56 may be disposed on one surface of the intermediate plate 53, for example, a surface of the intermediate plate 53 facing the first ring 51. A second rotating hub 57 may be disposed on an opposite surface of the intermediate plate 53, for example, on a surface of the intermediate plate 53 facing the second ring 52. The first rotating hub 56 and the second rotating hub 57 have the same structure; therefore, only the first rotating hub 56 will be described in detail. However, the first rotating hub 56 will be referred to as the rotating hub 56 for convenience of description.

The rotating hub 56 may be formed of a plurality of hub plates 561 that are disposed perpendicular to the intermediate plate 53 around the shaft hole 53*a*. In this case, the plurality of hub plates 561 are formed to evenly distribute the air introduced through the first ring 51 in the longitudinal direction of the plurality of first blades 54 when the intermediate plate 53 rotates. In addition, each of the plurality of hub plates 561 is formed in a smooth shape without protrusions on the outer surface thereof.

For example, as illustrated in FIGS. 19 to 21, the plurality of hub plates 561 may be implemented as a plurality of sub blades 561 disposed at regular intervals on the intermediate plate 53 about the shaft hole 53*a*. The plurality of sub blades 561 are arranged in a circular shape centering on the shaft hole 53*a*. Thus, as illustrated in FIG. 21, the plurality of sub blades 561 form a circle spaced apart from the circle formed by the plurality of first blades 55.

Each of the plurality of sub blades 561 has a length Ls shorter than the length Lb of each of the plurality of blades 54. For example, the length Ls of each of the plurality of sub blades 561 may be defined in a range of ⅓ to ⅔ of the length Lb of each of the plurality of blades 54. Further, the diameter Ds of the virtual outer circle formed by the plurality of sub blades 561 may be defined in a range of ⅓ to ⅘ of the diameter Db of the virtual inner circle formed by the plurality of blades 54.

In addition, each of the plurality of sub blades 561 may have a substantially rectangular shape, and may be formed to have a streamlined cross-section similar to each of the plurality of blade 54. Each of the plurality of sub blades 561 may be formed as a curved surface curved at a predetermined curvature in the width direction. The plurality of sub blades 561 may be formed such that the bending direction of each of the plurality of sub blades 561 is opposite to the bending direction of each of the plurality of blades 54. In this case, the exit angle of each of the plurality of sub blades 561 may be the substantially same as the entrance angle of each of the plurality of blades 54.

At this time, the length Ls, the diameter Ds of the virtual outer circle, and the cross-sectional shape of the plurality of sub blades 561 may be defined such that the plurality of sub blades 561 appropriately distribute the air flow when the double suction fan 50 rotates.

In addition, in the double suction fan 50 according to an embodiment of the disclosure, each of the plurality of sub blades 561 and 571 constituting the rotating hubs 56 and 57 is a curved plate having a streamlined cross-section that forms a straight line in the longitudinal direction of the plurality of blades 54 and 55; therefore, the plurality of sub blades 561 have a smooth shape without protrusions or undercuts in the longitudinal direction of the plurality of blades 54 and 55. Thus, when manufacturing the double suction fan 50 though the injection process, the plurality of sub blades 561 and 571 do not interfere with a core configured to form the rotating hubs 56 and 57.

As described above, when the rotating hubs 56 and 57 are formed of the plurality of sub blades 561 and 571, the spaces inside the plurality of blades 54 and 55 are divided into two regions based on the plurality of sub blades 561 and 571 in the longitudinal direction of the plurality of blades 54 and 55. In other words, as illustrated in FIG. 22, the inner space of the plurality of blades 54 and 55 is divided into a double blade region (section A) in which the plurality of sub blades 561 and 571 are positioned and a single blade region (section B) without a plurality of sub blades.

When the double suction fan 50 rotates, a suction force is generated in the plurality of sub blades 561 and 571, and the surrounding air is sucked and discharged in the radial direction as illustrated in FIG. 22. Therefore, between the plurality of sub blades 561 and 571 and the plurality of blades 54 and 55 of the double blade region A, there is only an air flow moving in the radial direction.

In addition, as illustrated in FIG. 22, some air that is not introduced into the plurality of sub blades 561 and 571 may be discharged through the plurality of blades 54 and 55 of the single blade region B by the air flow discharged radially from the plurality of sub blades 561 and 571. Thus, the air flow in the single blade region B is separated from the double blade region A, so that the single blade region B may serve as a separate fan. In other words, the single blade region B has the same flow characteristics as a separate centrifugal fan having short blades, so that the introduced air may be distributed evenly in the longitudinal direction of the blades, and the back flow of air at the blade ends may be prevented.

When the plurality of sub blades 561 and 571 are disposed inside the plurality of blades 54 and 55 as described above, the double suction fan 50 has the characteristics of a hybrid fan in which two types of fans are connected in series. Therefore, the overall static pressure characteristics of the double suction fan 50 may be improved.

Hereinafter, the air flow dispersed by the double suction fan according to an embodiment of the disclosure having the above-described structures will be described with reference to FIGS. 23 and 24.

Figure 23:
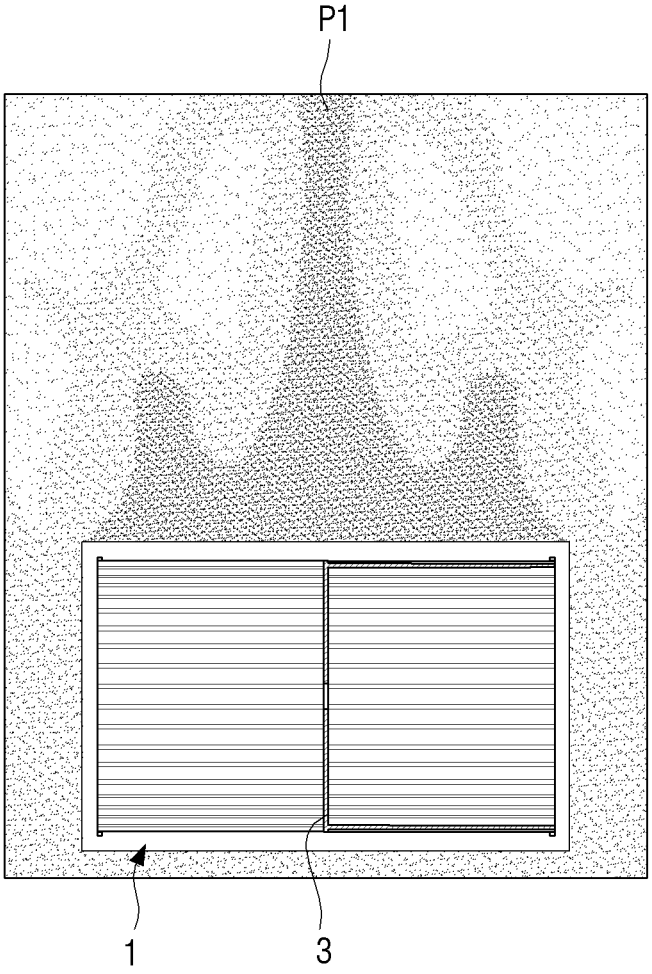
FIG. 23 is a view illustrating air flow in a conventional double suction fan.
Figure 24:
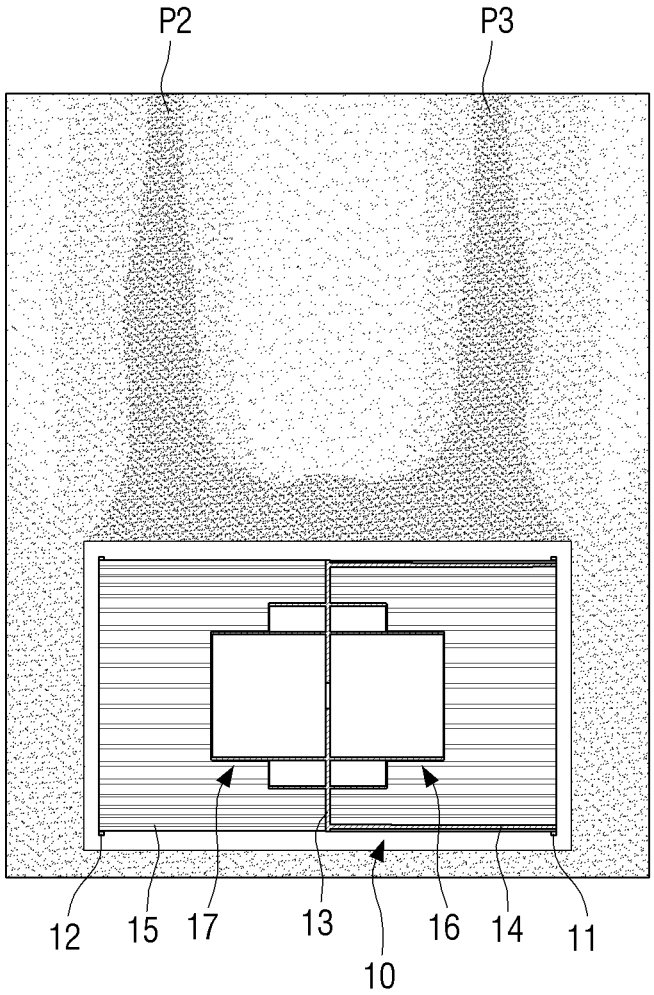
FIG. 24 is a view illustrating air flow in a double suction fan according to an embodiment of the disclosure.

FIG. 23 is a view illustrating air flow in a conventional double suction fan. FIG. 24 is a view illustrating air flow in a double suction fan according to a first embodiment of the disclosure.

As can be seen in FIG. 23, in the conventional double suction fan 1 in which the intermediate plate 3 has no rotating hub, the air flow is concentrated to the central portion P1 of the double suction fan 1 in which the intermediate plate 3 is positioned. However, in the double suction fan 10 according to an embodiment of the disclosure in which the rotating hubs 16 and 17 are formed on the intermediate plate 13, the air flow is distributed to two places P2 and P3 on both sides of the intermediate plate 13 as illustrated in FIG. 24. In addition, in the double suction fan 10 according to an embodiment of the disclosure, the back flow of air at both ends of the blades 14 and 15, that is, near the first ring 11 and the second ring 12 is reduced compared to the conventional double suction fan 1.

Therefore, in the case that a fan system used in the air conditioner is implemented with two double suction fans, when the conventional double suction fan 1 is used, there are two places where the air flow is concentrated on the surface of the heat exchanger. However, when the double suction fan 10 according to an embodiment of the disclosure is used, there are four places where the air flow is concentrated on the surface of the heat exchanger. As a result, the flow rate of the air passing through the heat exchanger is slowed down so that the pressure drop is small and the distribution of the air flow becomes uniform as a whole. In general, the more uniform the distribution of the air flow passing through the heat exchanger, the better the cooling and heating performance of the air conditioner. Therefore, by using the double suction fan 10 according to an embodiment of the disclosure, the cooling and heating performance of the air conditioner may be improved.

In order to confirm this performance improvement, the inventors conducted a computer simulation comparing the conventional double suction fan 1 and the double suction fan 10 according to an embodiment of the disclosure.

Figure 25:
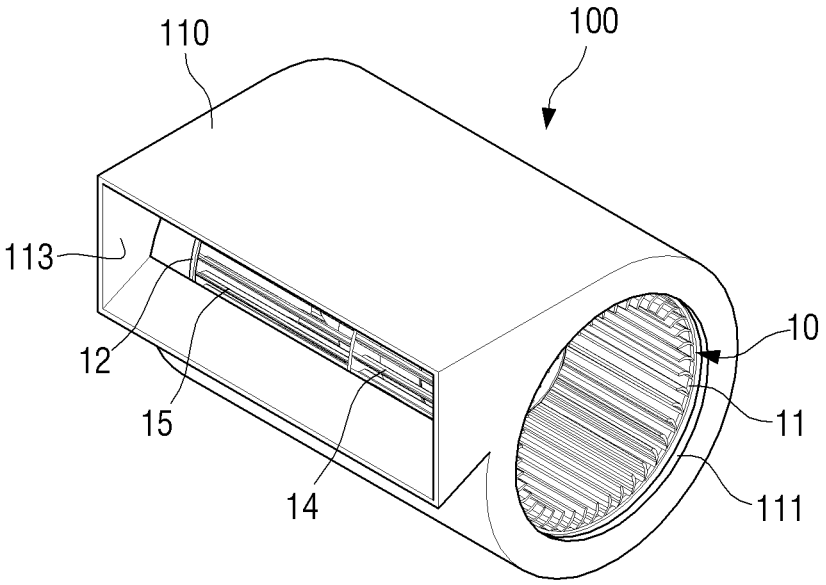
FIG. 25 is a perspective view illustrating a fan assembly using a double suction fan according to an embodiment of the disclosure.

The computer simulation was performed using a fan assembly 100 in which the double suction fan 10 is disposed inside a fan duct 110. FIG. 25 is a perspective view illustrating a fan assembly using a double suction fan according to an embodiment of the disclosure.

Referring to FIG. 25, the double suction fan 10 is disposed inside the fan duct 110, and the both side surfaces of the fan duct 110 are provided with two inlets 111 corresponding to the first ring 11 and the second ring 12 of the double suction fan 10. A discharge port 113 through which air discharged through the plurality of blades 14 and 15 of the double suction fan 10 is discharged is provided in the front surface of the fan duct 110. Therefore, when the double suction fan 10 rotates, outside air is introduced into the double suction fan 10 through the two inlets 111 of the fan assembly 100 and discharged to the outside through the discharge port 113.

In order to compare the performance of the conventional double suction fan 1 and the performance of the double suction fan 10 according to an embodiment of the disclosure, the distribution of the flow rate of air at a position approximate 300 mm away from the front of the discharge port 113 of the fan assembly 100 (generally, the position where a heat exchanger is disposed) was compared. In general, the distribution of the flow rate of air may be determined using a bar graph. For reference, the conventional double suction fan 1 was also tested in a state in which the conventional double suction fan 1 is disposed in the fan duct 110 as illustrated in FIG. 25.

Figure 26:
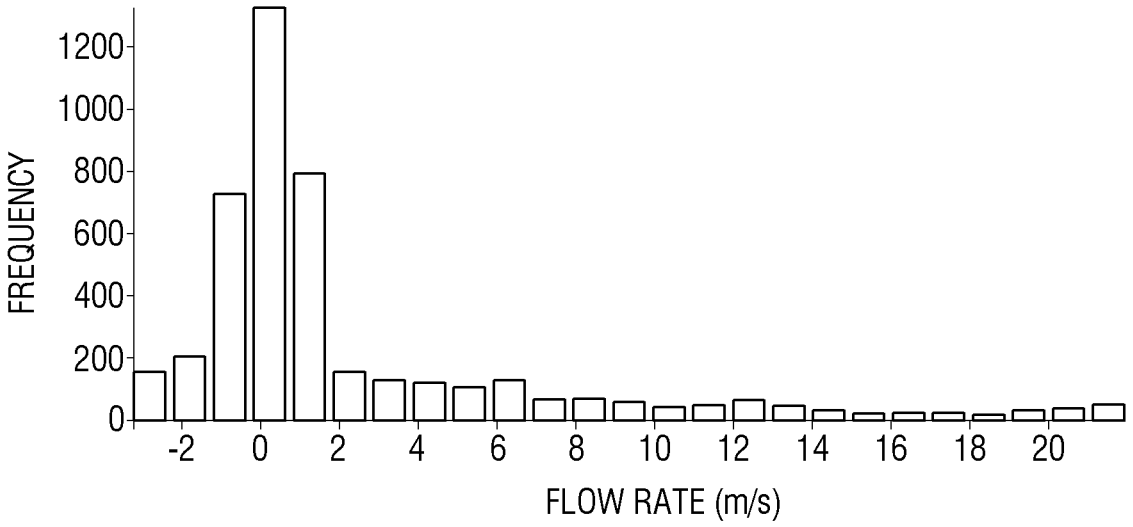
FIG. 26 is a bar graph illustrating a flow rate distribution of a conventional double suction fan.
Figure 27:
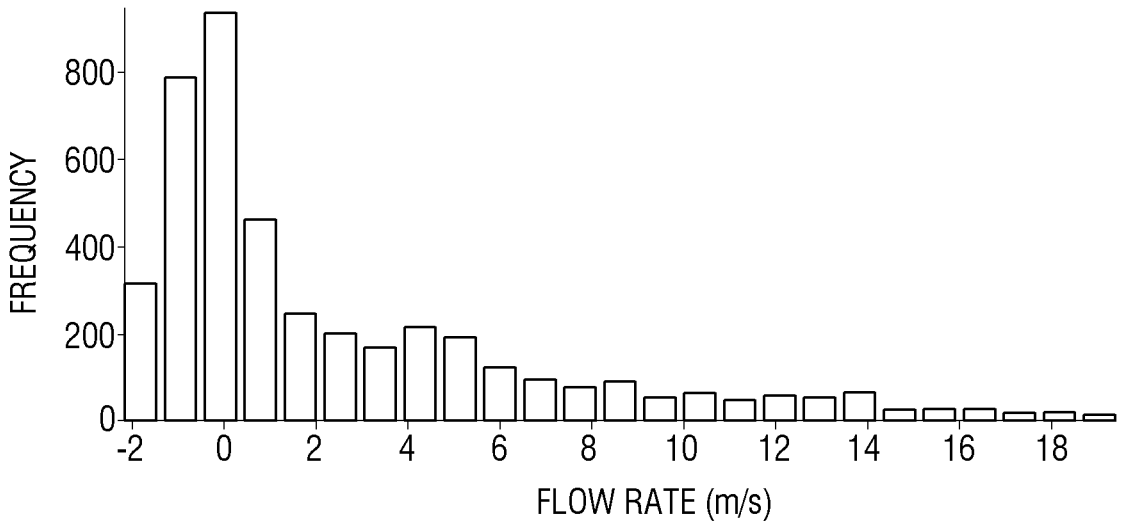
FIG. 27 is a bar graph illustrating a flow rate distribution of a double suction fan according to an embodiment of the disclosure.

FIG. 26 is a bar graph illustrating a flow rate distribution of a conventional double suction fan, and FIG. 27 is a bar graph illustrating a flow rate distribution of a double suction fan according to an embodiment of the disclosure. For reference, in FIGS. 26 and 27, the horizontal axis represents the flow rate (m/s), and the vertical axis represents the frequency of the flow rate (frequency).

Referring to FIG. 26, in the conventional double suction fan 1 without the rotating hub, the frequency of the area having the flow rate of 0 m/s is very large, and the frequencies of the areas having flow rates of 1 m/s to 4 m/s that are the distribution of the main flow rate are relatively small. However, in the case of including the rotating hubs 16 and 17, such as the double suction fan 10 according to an embodiment of the disclosure, as illustrated in FIG. 27, the flow rates have a wide flow rate distribution without being biased to a specific flow rate as compared to the conventional double suction fan 1.

Table 1 shows the result of comparing the overall flow performance of the conventional double suction fan 1 and the double suction fan 10 according to an embodiment of the disclosure.

TABLE 1

| | unit | Prior art(without hub) | present disclosure(with hub) |
|---|---|---|---|
| External static pressure(ESP) | Pa | 0 | 0 |
| Amount of air flow | Cmm | 37.19 | 37.07 |
| Average flow rate | m/s | 2.98 | 2.97 |
| Flow rate standard deviation | m/s | 6.31 | 5.86 |
| Flow rate standard deviation/ Average flow rate | % | 211.74 | 197.3 |

As can be seen in Table 1, in the double suction fan 10 according to an embodiment of the disclosure including the rotating hubs 56 and 57, the amount of air flow is hardly reduced as compared to the conventional double suction fan 1. However, the standard deviation of the flow rate of the double suction fan 10 according to an embodiment of the disclosure is improved compared to that of the conventional double suction fan 1.

In the above, the experiment performed using the double suction fan 10 according to the first embodiment of the disclosure has been described as an example. However, using the double suction fans 20, 30, 40, and 50 according to another embodiments of the disclosure may also obtain experimental results similar to the above-described result.

With the double suction fan according to an embodiment of the disclosure having the structure as described above, because the rotating hubs are provided on the intermediate plate, the phenomenon that the air flow is concentrated in the center portion of the double suction fan may be reduced.

In addition, because the double suction fan according to an embodiment of the disclosure may be manufactured through the injection process, the manufacturing cost may be reduced.

An air conditioner may be configured by using a double suction fan according to the embodiment of the disclosure having the improved performance as described above.

The conventional air conditioner uses a fan system configured by connecting three double suction fans that use blades having a length of 200 mm and have no rotating hub to blow air to a heat exchanger. However, there is a problem in that it is necessary to use couplers having a flexibility in order to connect the three double suction fans in this way, thereby amplifying the structural vibration of the fan system. In addition, because the structure is complicated by the use of three double suction fans, there is a problem that the cost is high.

However, these problems may be solved by implementing a fan system using two double suction fans according to an embodiment of the disclosure having long blades and rotating hubs.

Figure 28:
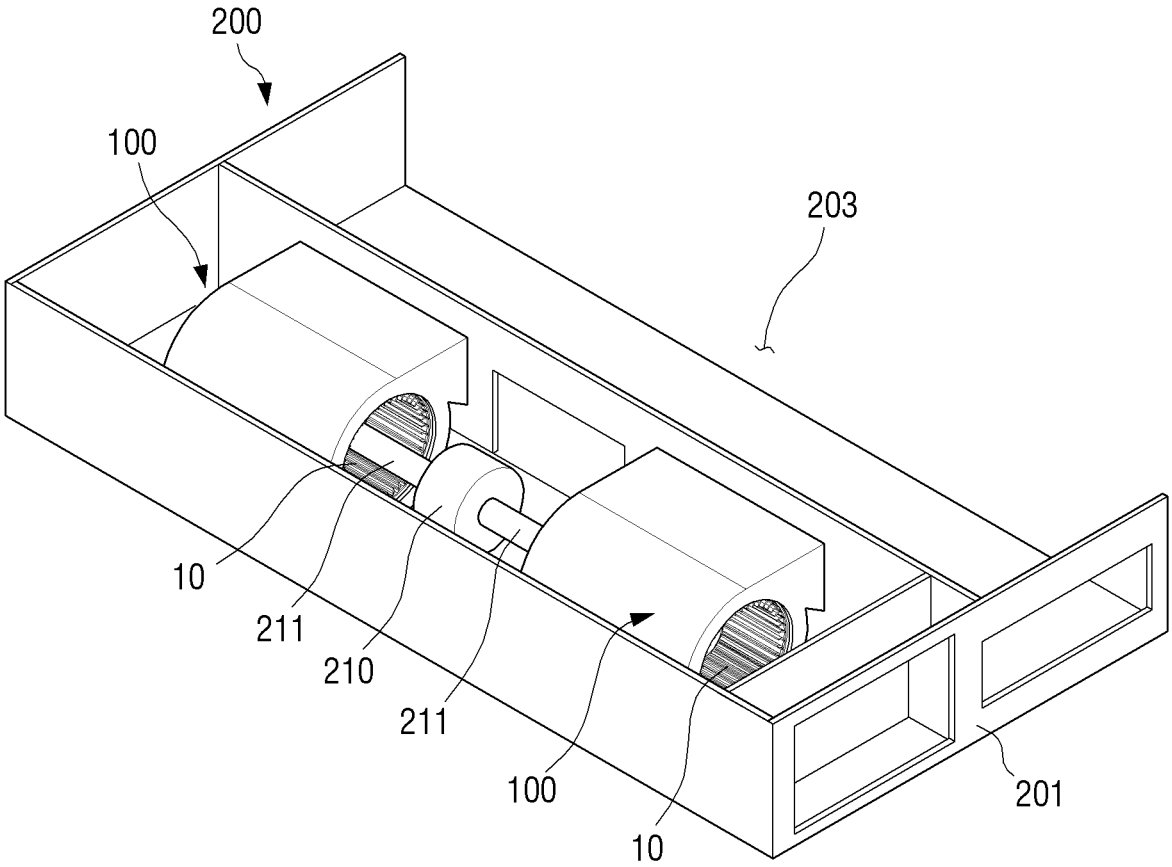
FIG. 28 is a perspective view illustrating a fan system of an air conditioner using two double suction fans according to an embodiment of the disclosure.

FIG. 28 is a perspective view illustrating a fan system of an air conditioner using two double suction fans according to an embodiment of the disclosure. For reference, in FIG. 28, the top surface of a main duct 201 is removed for convenience of illustration and description.

Referring to FIG. 28, a fan system 200 may include two fan assemblies 100 and one motor 210 disposed in the main duct 201.

The motor 210 is disposed between the two fan assemblies 100. The shafts 211 provided at both ends of the motor 210 are respectively fixed to the shaft holes 13*a* of the intermediate plates 13 of the two double suction fans 10 provided at both sides thereof. Therefore, when the motor 210 rotates, the two double suction fans 10 are simultaneously rotated to discharge the air.

A heat exchanger (not illustrated) is disposed in front of a discharge port 203 of the main duct 201. Therefore, the air discharged from the main duct 201 is heat exchanged in the heat exchanger.

Like an air conditioner according to an embodiment of the disclosure, when the fan system 200 is configured with two double suction fans 10 having a plurality of blades 14 and 15 having a length of 320 mm and rotating hubs 16 and 17, the same or superior performance as that of the fan system configured by three conventional double suction fans 1 having a plurality of blades having a length of 200 mm without a rotating hub may be ensured. In addition, because the air conditioner according to an embodiment of the disclosure uses two double suction fans 10, the manufacturing cost may be lowered and noise may be reduced.

While the embodiments of the disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A double suction fan comprising:

a first ring and a second ring in parallel with each other;

an intermediate plate, between the first ring and second ring, and having a first side surface and a second side surface opposite to each other and a shaft hole passing through the first side surface and the second side surface in a center of the intermediate plate;

a plurality of first blades, each blade of the plurality of first blades extending from the first ring to the intermediate plate;

a plurality of second blades, each blade of the plurality of second blades extending from the second ring to the intermediate plate;

a first rotating hub, on the first side surface of the intermediate plate, having a plurality of hub plates perpendicular to the first side surface of the intermediate plate around the shaft hole, and each hub plate of the plurality of hub plates of the first rotating hub having a smooth outer surface without protrusions, so that air introduced through the first ring is evenly distributed in a longitudinal direction of the plurality of first blades when the intermediate plate rotates; and a second rotating hub, on the second side surface of the intermediate plate, having a plurality of hub plates perpendicular to the second side surface of the intermediate plate around the shaft hole, and each hub plate of the plurality of hub plates of the second rotating hub having a smooth outer surface without protrusions, so that air introduced through the second ring is evenly distributed in a longitudinal direction of the plurality of second blades when the intermediate plate rotates, wherein, when the intermediate plate rotates, a contour formed by the plurality of hub plates of the first rotating hub forms a shape having a center portion that is higher than an edge portion of the intermediate plate, and a contour formed by the plurality of hub plates of the second rotating hub forms a shape having a center portion that is higher than the edge portion of the intermediate plate, wherein the plurality of hub plates of the first rotating hub comprises a first plurality of circular pipes disposed concentrically around the shaft hole, and lengths of the first plurality of circular pipes become shorter from an edge of the first ring to the edge of the intermediate plate, and the plurality of hub plates of the second rotating hub comprises a second plurality of circular pipes disposed concentrically around the shaft hole, and lengths of the second plurality of circular pipes become shorter from an edge of the second ring to the edge of the intermediate plate.

2. The double suction fan of claim 1, wherein the plurality of hub plates of the first rotating hub comprises a first circular pipe, which is among the first plurality of circular pipes, on the first side surface of the intermediate plate around the shaft hole, and a second circular pipe, which is among the first plurality of circular pipes, concentrically outside the first circular pipe on the first side surface of the intermediate plate and being shorter in length than the first circular pipe, and the plurality of hub plates of the second rotating hub comprises a first circular pipe, which is among the second plurality of circular pipes, on the second side surface of the intermediate plate around the shaft hole, and a second circular pipe, which is among the second plurality of circular pipes, concentrically outside the first circular pipe on the second side surface of the intermediate plate and being shorter in length than the first circular pipe.

3. The double suction fan of claim 1, wherein the first ring and the second ring, the intermediate plate, the plurality of first blades, the plurality of second blades and the first and second rotating hubs are all injection molded together as a single injection molded structure.

4. The double suction fan of claim 1, wherein each first blade of the plurality of first blades has a same length, and a length of the first rotating hub is ⅓ to ⅔ of a length of each first blade, and each second blade of the plurality of second blades has a same length to that of each first blade, and a length of the second rotating hub is ⅓ to ⅔ of a length of each second blade.

5. A double suction fan comprising:

a plurality of components injection molded together as a single injection molded structure, the plurality of components including:

a first ring and a second ring in parallel with each other, an intermediate plate, between the first ring and the second ring, and having a first side surface and a second side surface opposite to each other and a shaft hole passing through the first side surface and the second side surface in a center of the intermediate plate, a plurality of first blades, each blade of the plurality of first blades extending from the first ring to the intermediate plate, a plurality of second blades, each blade of the plurality of second blades extending from the second ring to the intermediate plate, a first rotating hub, on the first side surface of the intermediate plate, having a plurality of hub plates perpendicular to the first side surface of the intermediate plate around the shaft hole, and each hub plate of the plurality of hub plates of the first rotating hub having an outer surface without protrusions, and a second rotating hub, on the second side surface of the intermediate plate, having a plurality of hub plates perpendicular to the second side surface of the intermediate plate around the shaft hole, and each hub plate of the plurality of hub plates of the second rotating hub having an outer surface without protrusions, wherein, when the intermediate plate rotates, a contour formed by the plurality of hub plates of the first rotating hub forms a shape having a center portion that is higher than an edge portion of the intermediate plate, and a contour formed by the plurality of hub plates of the second rotating hub forms a shape having a center portion that is higher than the edge portion of the intermediate plate, wherein the plurality of hub plates of the first rotating hub comprises a first plurality of circular pipes disposed concentrically around the shaft hole, and lengths of the first plurality of circular pipes become shorter from an edge of the first ring to the edge of the intermediate plate, and the plurality of hub plates of the second rotating hub comprises a second plurality of circular pipes disposed concentrically around the shaft hole, and lengths of the second plurality of circular pipes become shorter from an edge of the second ring to the edge of the intermediate plate.

6. An air conditioner comprising:

first and second double suction fans, each of the first and second double suction fans including:

a first ring and a second ring in parallel with each other, an intermediate plate, between the first ring and the second ring, and having a first side surface and a second side surface opposite to each other and a shaft hole passing through the first side surface and the second side surface in a center of the intermediate plate, a plurality of first blades, each blade of the plurality of first blades extending from the first ring to the intermediate plate, a plurality of second blades, each blade of the plurality of second blades extending from the second ring to the intermediate plate, a first rotating hub, on the first side surface of the intermediate plate, having a plurality of hub plates perpendicular to the first side surface of the intermediate plate around the shaft hole, and each hub plate of the plurality of hub plates of the first rotating hub having a smooth outer surface without protrusions, so that air introduced through the first ring is evenly distributed in a longitudinal direction of the plurality of first blades when the intermediate plate rotates, and a second rotating hub, on the second side surface of the intermediate plate, having a plurality of hub plates perpendicular to the second side surface of the intermediate plate around the shaft hole, and each hub plate of the plurality of hub plates of the second rotating hub having a smooth outer surface without protrusions, so that air introduced through the second ring is evenly distributed in a longitudinal direction of the plurality of second blades when the intermediate plate rotates;

wherein, when the intermediate plate rotates, a contour formed by the plurality of hub plates of the first rotating hub forms a shape having a center portion that is higher than an edge portion of the intermediate plate, and a contour formed by the plurality of hub plates of the second rotating hub forms a shape having a center portion that is higher than the edge portion of the intermediate plate, wherein the plurality of hub plates of the first rotating hub comprises a first plurality of circular pipes disposed concentrically around the shaft hole, and lengths of the first plurality of circular pipes become shorter from an edge of the first ring to the edge of the intermediate plate, and the plurality of hub plates of the second rotating hub comprises a second plurality of circular pipes disposed concentrically around the shaft hole, and lengths of the second plurality of circular pipes become shorter from an edge of the second ring to the edge of the intermediate plate, wherein the air conditioner further comprises:

a motor;

a first shaft coupling the motor to the shaft hole of the intermediate plate of the first double suction fan, so that that the intermediate plate of the first double suction fan is rotatable by the motor; and a second shaft coupling the motor to the shaft hole of the intermediate plate of the second double suction fan, so that that the intermediate plate of the second double suction fan is rotatable by the motor.

* * * * *